US007475972B2

(12) United States Patent
Qingguo et al.

(10) Patent No.: US 7,475,972 B2
(45) Date of Patent: Jan. 13, 2009

(54) ONE-WAY VALVE, VALVE UNIT ASSEMBLY, AND INK CARTRIDGE USING THE SAME

(75) Inventors: Xiao Qingguo, Zhuhai (CN); Li Yu, Zhuhai (CN)

(73) Assignee: Unicorn Image Products Co. Ltd. of Zhuhai, Zhuhai (CN)

( * ) Notice: Subject to any disclaimer, the term of this patent is extended or adjusted under 35 U.S.C. 154(b) by 451 days.

(21) Appl. No.: 11/141,687

(22) Filed: May 31, 2005

(65) Prior Publication Data

US 2005/0288874 A1 Dec. 29, 2005

Related U.S. Application Data

(63) Continuation of application No. 10/186,872, filed on Jun. 28, 2002, now Pat. No. 6,935,730.

(51) Int. Cl.
*B41J 2/175* (2006.01)

(52) U.S. Cl. ..... 347/86; 347/85

(58) Field of Classification Search ..... 347/85–87
See application file for complete search history.

(56) References Cited

U.S. PATENT DOCUMENTS

| | | | |
|---|---|---|---|
| 4,053,902 | A | 10/1977 | Skafvenstedt et al. |
| 4,383,263 | A | 5/1983 | Ozawa et al. |
| 4,422,084 | A | 12/1983 | Saito |
| 4,463,362 | A | 7/1984 | Thomas |
| 4,509,062 | A | 4/1985 | Low et al. |
| 4,555,719 | A | 11/1985 | Arway et al. |
| 4,677,447 | A | 6/1987 | Nielsen |
| 4,700,202 | A | 10/1987 | Kuranishi et al. |
| 4,791,438 | A | 12/1988 | Hanson et al. |
| 4,994,824 | A | 2/1991 | Winslow |
| 5,085,355 | A | 2/1992 | Yoshimura et al. |
| 5,233,369 | A | 8/1993 | Carlotta et al. |
| 5,270,739 | A | 12/1993 | Kitani et al. |

(Continued)

FOREIGN PATENT DOCUMENTS

| | | |
|---|---|---|
| CN | 1 133 784 | 10/1996 |

(Continued)

*Primary Examiner*—An H Do
(74) *Attorney, Agent, or Firm*—Fay Sharpe LLP

(57) ABSTRACT

A one-way valve, a valve unit assembly and ink cartridge using this valve or valve unit assembly for controlling ink flow are disclosed. The one-way valve includes a foot support portion, a wall support portion projecting at an angle from an interior side of the foot support portion, a shoulder support portion bending towards an interior side of the wall support portion, and a head support portion projecting from a shoulder support portion with a through hole. The valve unit assembly includes a bottom cover with a through hole for holding the one-way valve, a pressing cover with a through hole, and an elastic one-way valve disposed between the bottom cover and the pressing cover. The pressing cover is maintained selectively in contact with the head support portion through hole by a pressure difference. The one-way valve and the valve unit assembly are disposed in an ink chamber to replace a porous member usually used in the ink chamber. As a result, the ink cartridge using the one-way valve can store more ink and remaining ink is handled in a more environment friendly manner.

16 Claims, 24 Drawing Sheets

U.S. PATENT DOCUMENTS

| | | | |
|---|---|---|---|
| 5,280,299 | A | 1/1994 | Saikawa et al. |
| 5,365,260 | A | 11/1994 | Kitani et al. |
| 5,453,772 | A | 9/1995 | Aono et al. |
| 5,477,963 | A | 12/1995 | Mochizuki et al. |
| 5,479,198 | A | 12/1995 | Kawano et al. |
| 5,488,401 | A | 1/1996 | Mochizuki et al. |
| 5,500,665 | A | 3/1996 | Ujita et al. |
| 5,504,511 | A | 4/1996 | Nakajima et al. |
| 5,576,749 | A | 11/1996 | Mochizuki et al. |
| 5,606,988 | A | 3/1997 | Pawlowski, Jr. |
| 5,608,437 | A | 3/1997 | Iwata et al. |
| 5,633,667 | A | 5/1997 | Miyazawa |
| D390,598 | S | 2/1998 | Miyazawa et al. |
| 5,719,609 | A | 2/1998 | Hauck et al. |
| 5,777,647 | A | 7/1998 | Pawlowski, Jr. et al. |
| 5,790,158 | A | 8/1998 | Shinada et al. |
| 5,812,155 | A | 9/1998 | Seccombe |
| 5,838,352 | A | 11/1998 | Martinez |
| 5,847,735 | A | 12/1998 | Betschon |
| 5,852,459 | A | 12/1998 | Pawlowski, Jr. et al. |
| 5,889,543 | A | 3/1999 | Miyazawa et al. |
| 5,903,293 | A | 5/1999 | Nikkels et al. |
| 5,949,456 | A | 9/1999 | Matsumoto et al. |
| 5,949,458 | A | 9/1999 | Studholme |
| 6,000,788 | A | 12/1999 | Iida |
| 6,039,441 | A | 3/2000 | Tomikawa et al. |
| 6,042,224 | A | 3/2000 | Oda et al. |
| 6,045,207 | A | 4/2000 | Mochizuki et al. |
| D427,236 | S | 6/2000 | Shinada et al. |
| 6,070,976 | A | 6/2000 | Takagi et al. |
| 6,130,694 | A | 10/2000 | Beatty |
| 6,145,974 | A | 11/2000 | Shinada et al. |
| 6,158,854 | A | 12/2000 | Watts et al. |
| 6,170,939 | B1 | 1/2001 | Ujita et al. |
| 6,193,364 | B1 | 2/2001 | Iida |
| 6,196,669 | B1 | 3/2001 | Harvey et al. |
| D440,600 | S | 4/2001 | Seino et al. |
| D442,219 | S | 5/2001 | Chou et al. |
| D443,639 | S | 6/2001 | Chou et al. |
| 6,247,803 | B1 | 6/2001 | Kanaya et al. |
| 6,257,711 | B1 | 7/2001 | Higuma et al. |
| 6,302,531 | B1 | 10/2001 | Usui et al. |
| 6,332,481 | B1 | 12/2001 | Shinada et al. |
| 6,350,026 | B1 | 2/2002 | Lin |
| 6,367,666 | B1 | 4/2002 | Hou et al. |
| 6,367,920 | B1 | 4/2002 | Kanai et al. |
| 6,382,784 | B2 | 5/2002 | Pawlowski, Jr. et al. |
| 6,416,152 | B1 | 7/2002 | Matsuzaki et al. |
| 6,422,691 | B2 | 7/2002 | Kobayashi et al. |
| 6,929,357 | B2 * | 8/2005 | Qingguo et al. ..... 347/85 |
| 2001/0020971 | A1 | 9/2001 | Usui et al. |
| 2002/0044184 | A1 | 4/2002 | Kobayashi et al. |
| 2002/0063758 | A1 | 5/2002 | Usui et al. |
| 2002/0135646 | A1 | 9/2002 | Usui |
| 2002/0140788 | A1 | 10/2002 | Usui et al. |
| 2002/0158948 | A1 | 10/2002 | Miyazawa et al. |
| 2002/0171721 | A1 | 11/2002 | Ota et al. |
| 2002/0171722 | A1 | 11/2002 | Hara et al. |
| 2002/0171723 | A1 | 11/2002 | Ota et al. |
| 2002/0180849 | A1 | 12/2002 | Sakai et al. |

FOREIGN PATENT DOCUMENTS

| | | | |
|---|---|---|---|
| CN | 1 185 379 | | 6/1998 |
| EP | 0 827 836 | A1 | 8/1997 |
| EP | 0 625 424 | B1 | 12/1999 |
| EP | 1 000 753 | A1 | 5/2000 |
| EP | 1 016 533 | A1 | 7/2000 |
| GB | 2 306 401 | A | 5/1997 |
| WO | WO 01/78987 | A1 | 10/2001 |
| WO | WO 02/20270 | A1 | 4/2002 |

* cited by examiner

D-D

E-E

F–F

G–G

K–K

L–L

ONE-WAY VALVE, VALVE UNIT ASSEMBLY, AND INK CARTRIDGE USING THE SAME

CROSS REFERENCE TO RELATED APPLICATIONS

This application is a continuation application of U.S. Ser. No. 10/186,872, filed Jun. 28, 2002 now U.S. Pat. No. 6,935,730, and claims priority from, and expressly incorporates by reference herein, pending U.S. application Ser. No. 09/930,517, filed Aug. 15, 2001, which claims priority from provisional U.S. application 60/225,722, filed Aug. 16, 2000, and International application PCT/CN01/00312, filed Feb. 28, 2001, which claims priority from Chinese application 00106428.2, filed Apr. 3, 2000.

BACKGROUND OF THE INVENTION

The present invention relates to a one-way valve, a valve unit assembly and an ink cartridge using the valve or the valve unit assembly to control ink flow.

Conventionally, in an ink jet printer, the printhead is connected with the ink cartridge for printing out characters or drawings. A basic requirement thereof is that the ink cartridge can supply ink to the printhead smoothly. Currently, a porous member such as sponge for storing ink by capillary force is used in ink cartridges. China patent publication No. CN1185379A discloses this kind of ink cartridge, as shown in FIG. 43, which is divided into two chambers 2 and 4. A foam 3 is employed to absorb the ink, and obviously the foam occupies a part of the volume or inner space of the ink cartridge. Volumetric efficiency, however, in using foam is about 60-65%. Therefore, these designs are deemed to be less efficient than desired since a reduced amount of ink is stored in the cartridge.

SUMMARY OF THE INVENTION

The present invention provides a one-way valve or a valve unit assembly. The one-way valve is bellows shaped in order to be deformed easily.

The present invention provides an ink cartridge employing the one-way valve or the valve unit assembly for controlling ink flow.

The one-way valve is designed as a bellows shape with a foot support portion, a wall support portion projecting from an interior of the foot support portion, a shoulder support portion bending toward an interior of the wall support portion, and a head support portion with a through hole projecting from the shoulder support portion. And the valve unit assembly of the present invention includes a bottom cover with a through hole for supporting the valve, a pressing cover with a through hole, and an elastic valve disposed between the bottom cover and the pressing cover, the through hole of the head support portion of the valve selectively contacting the non-through hole portion of the pressing cover.

The ink cartridge of the present invention comprises at least an ink chamber with an ink outlet, and a one-way valve disposed between the ink chamber and the ink outlet. A pressing cover is maintained selectively in contact with the one-way valve head support portion through hole by a pressure difference. In addition, as another preferred embodiment, the one-way valve and the pressing cover can be substituted for a valve unit assembly which comprises a bottom cover with a through hole for holding a valve, a pressing cover with a through hole, and an elastic valve with a head support portion through hole disposed between the bottom cover and the pressing cover, said pressing cover being maintained selectively in contact with said head support portion through hole of said elastic valve by a pressure difference.

A valve socket for holding the one-way valve unit assembly is provided in the ink cartridge according to another preferred embodiment. The inlet of the one-way valve unit assembly is connected with the ink chamber, and the outlet of the one-way valve unit assembly is connected to the ink outlet. As a result, when the pressure difference between an inlet side and outlet side varies during printing, the one-way valve opens or closes automatically, and adjusts the ink flow.

BRIEF DESCRIPTION OF THE DRAWINGS

The present invention is exemplified in the following drawings and the preferred embodiments.

DESCRIPTION OF THE PREFERRED EMBODIMENTS

Figure 1:
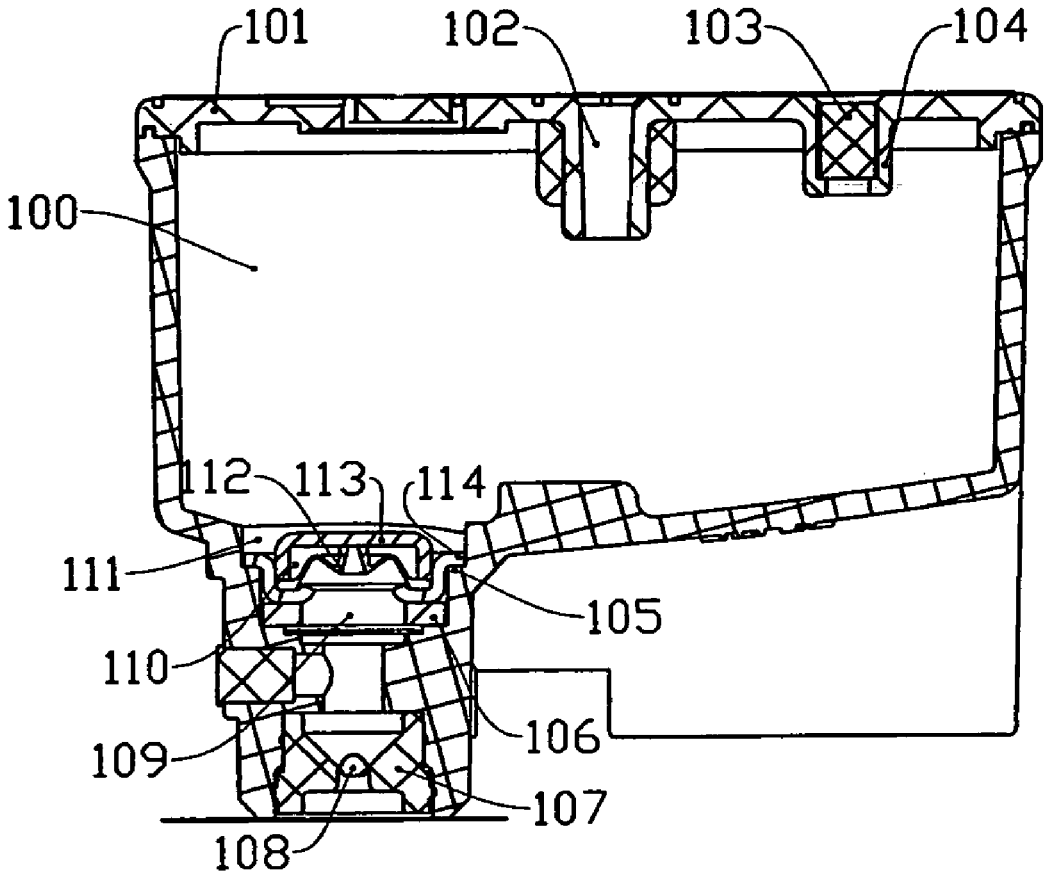
FIG. 1 is a sectional view showing the configuration of the ink cartridge of a first embodiment.

A number of different embodiments are described below in conjunction with various environments in which the present invention is employed. It will be understood that like terms are used to describe like components, even though different reference numerals may be used when referring to specific components of a particular embodiment.

Embodiment One

In FIG. 1, a one-way valve unit assembly 110 is illustrated for use in this embodiment. The one-way valve unit assembly is located in a valve socket 111 of ink chamber 100, and cylindrical wall of a bottom cover 114 extends along an interior wall of the valve socket 111 and a flange of the bottom cover 114 contacts step 105 of the valve socket 111. The ink flow from the ink chamber 100 to ink outlet 109 is controlled by selective opening or closing of valve 112, the structure and operation of which will be described in greater detail below with respect to FIG. 3. To ensure ink flow from the one-way valve unit 110 to ink outlet 109, it is necessary to seal the region between the exterior of the bottom cover of the one-way valve unit assembly 110 and corresponding side walls, bottom wall or steps. According to the present invention, one preferred material for the bottom cover of the one-way valve unit assembly 110, may be a metal such as copper, or the sealing may be achieved by fusion, by use of an adhesive, or by adding an elastic sealing member. In this embodiment, a sealing member 106 is provided between the bottom cover of the one-way valve unit and the bottom portion of the valve socket 111. Moreover, an air vent 102 and an ink filling port 104 which is sealed by a colloid stopper 103 are set in cover 101 of the ink cartridge.

Figure 2:
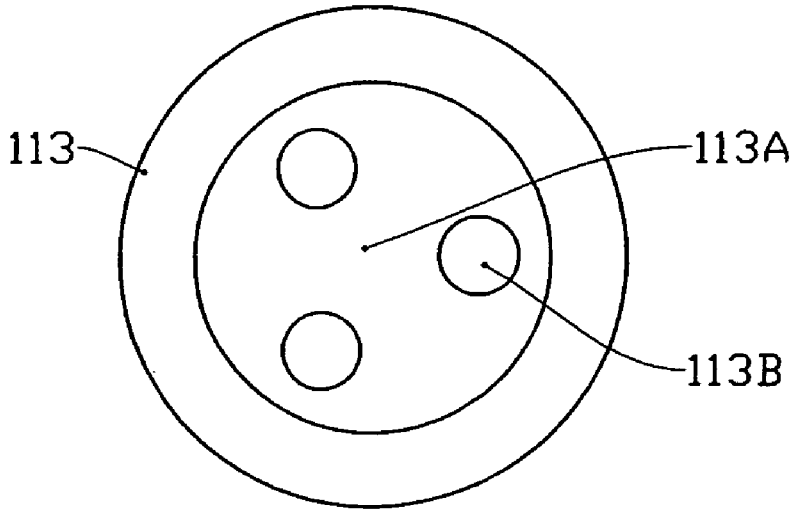
FIG. 2 is a sectional view showing the configuration of a pressing cover of the one-way valve unit assembly of the first embodiment.
Figure 3:
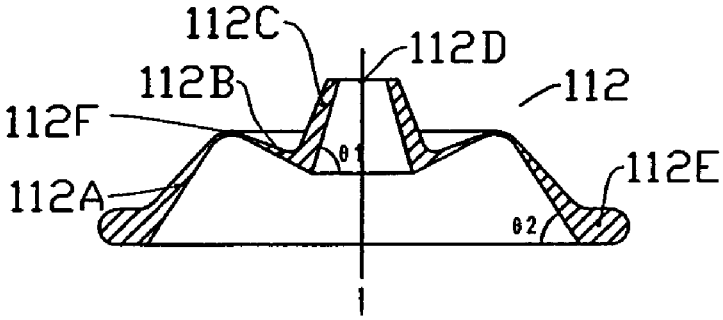
FIG. 3 is a sectional view showing the configuration of the one-way valve.

FIG. 2 shows top view of pressing cover 113 of the one-way valve unit assembly of this embodiment. There are three troughs 113B in the pressing cover 113, and a valve plane region 113A being maintained selectively in contact with the head support portion through hole of the valve 112. FIG. 3 shows a sectional view of a bellows valve 112 that is preferably formed of a rubber with a Shore degree hardness of 30°~65°, and a preferred profile of the bellows is a truncated cone. The bellows valve includes a foot support portion 112E, that abuttingly engages and is supported by an internal wall of bottom cover 114. The foot support portion is dimensioned for sealing contact with the wall. The enlarged thickness of the foot support portion 112E is reduced and tapered along wall support portion 112A. That is, the wall thins in cross section and tapers inwardly to a reduced diameter as the bellows valve merges from the foot support portion toward shoulder portion 112B. At the shoulder support portion 112B, the bellows valve undergoes a reverse curve, the shoulder support portion merging into an inwardly extending support section that defines a well or recess that supports head support portion 112C. The support portion has a through opening 112D. The shoulder portion 112B bends inwardly along the wall support portion 112A to support shoulder support portion 112B. The contour of the bellows valve is responsive to small or subtle pressure differences so that it regulates and controls ink flow to ink outlet 109.

When the printer operates, there is a difference of pressure between two sides of the bellows valve that results in the deformation of the bellows valve. The wall support portion 112A which bends to the inside of the shoulder support portion and forms the well, guarantees that the head support portion 112C moves in response to small pressure changes. In fact, the configuration of the shoulder support portion 112B guarantees that subtle changes result in movement or influence in head support portion 112C. Therefore, the configuration of the shoulder support portion 112B provides for a sensitive releasing of pressure.

The movement of the head support portion 112C is greater when there is a large negative pressure difference in order to both control the flow of ink and to reset the head support portion 112C quickly. Therefore the thickness of the foot support portion 112E is greater than that of the head support portion 112C and the supporting shoulder 112B of the valve. It is easy to understand that the thickness of shoulder support portion 112B is designed to be less than the thickness of the head support portion 112C, especially in the curved portion 112F which is ranges from approximately 0.15 to 0.5 mm. An opening or hole 112D in the wall support portion 112A is designed to be cone shaped. The head support portion 112C slopes inwardly at an angle θ1 of 85° which is greater than the slope angle of the foot support portion 112E represented by angle θ2 of 65°. An equilibrium condition is obtained when the sloping angle θ1 is reduced in response to negative pressure in the ink chamber.

Figure 4:
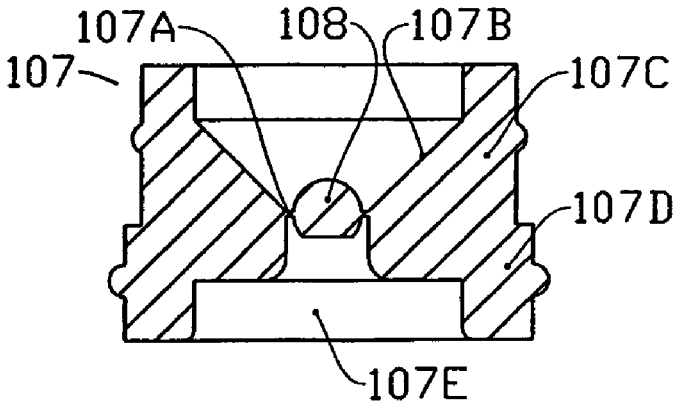
FIG. 4 is a sectional view showing the sealing member in the ink outlet.
Figure 5:
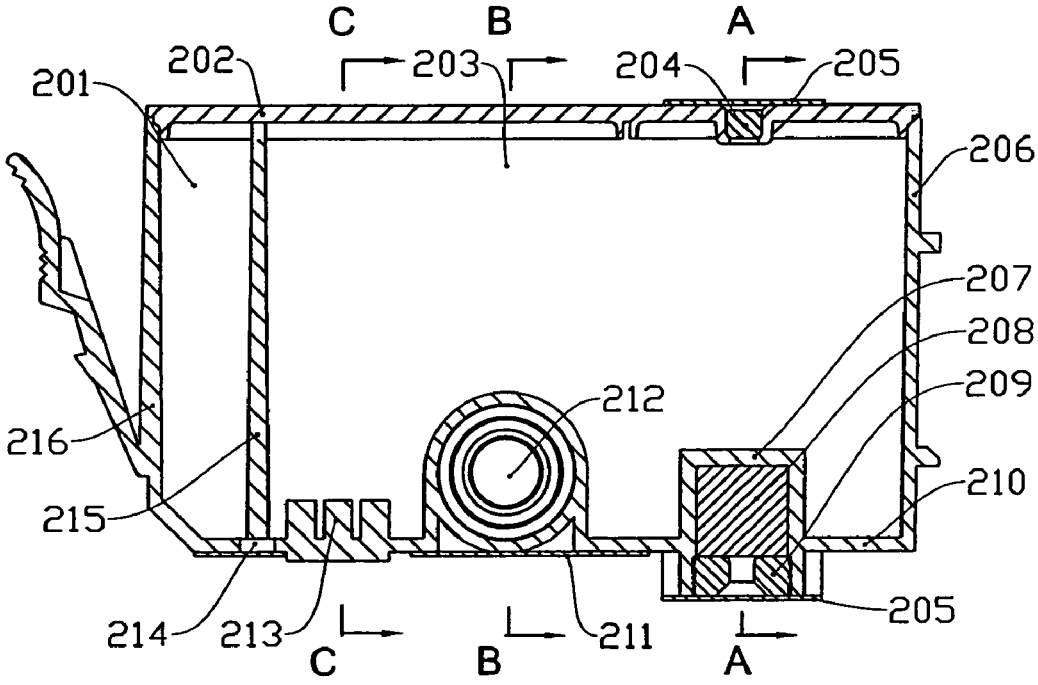
FIG. 5 is a sectional view showing the configuration of the ink cartridge of a second embodiment.

Referring to FIG. 4, a sealing member 107 has a block portion 108 that is selectively separated via a frangible connection 107A. A tapered surface 107B is provided inwardly of the sealing member to facilitate separation of the block portion 108 from the frangible connection 107A. The tapered surface 107B is provided to facilitate the block portion being pushed upward, the sloping angle formed between the tapered surface 107B and the lateral direction is preferably around 30~45 degrees. The sealing member 107 is made of an elastic material with Shore hardness 30~50 degrees. The block portion 108 has a generally cylindrical shape. When an ink supply needle (not shown) is inserted through sealing portion 107A, the block portion 107 of the sealing member at least partially separates from the remainder of the sealing member. The frangible connection portion is an average thickness. The width of the frangible connection 107A is 0.1~0.3 mm, and the thickness of the frangible connection portion 107A is 0.15~0.4 mm.

When the ink cartridge is mounted to the printer, an ink supply needle (not shown) punctures block 108 of sealing member 107. During printing, there is a pressure difference between two sides of the one-way valve unit assembly. The head support portion 112C of the bellows valve moves down when the degree of pressure reaches a predetermined level, e.g., −120 mm water, and the opening 112D is opened as the valve separates from the pressing cover 113, the liquid ink is filled into the ink outlet port. According to the valve 112 of this invention, the opening pressure is −200 to 0 mm water and optimum opening pressure is −150 to −30 mm water.

Embodiment Two

Figure 6:
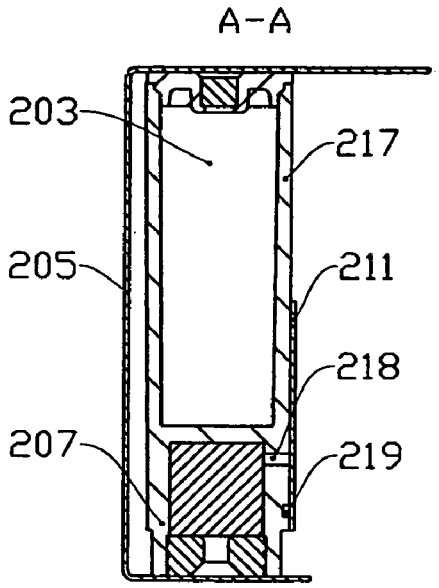
FIG. 6 is a cross-sectional view at a section taken along a line A-A of FIG. 5.

Referring to FIGS. 5-8, this embodiment also advantageously employs the one-way valve unit assembly between the ink chamber and the ink outlet. Moreover, in this embodiment, the ink chamber is further divided into a main ink chamber and supplementary ink chamber. The supplementary chamber is designed to supply ink to print several more pages after an ink out alarm is encountered. The ink chamber includes cap 202, two end walls 206 and 216, bottom side 210 and two side walls. A supplementary chamber 201 is separated from the main chamber 203 by a partition wall 215 and is connected with the main chamber 203 through an ink passage way 214. And an ink out detecting prism 213 is set near the ink passageway 214. The outlet of the valve socket 212 is connected to ink outlet 207. The sealing membrane 211 seals the process hole of the valve socket 212. A fiber 208 is disposed in an upper part of ink outlet 207, and a funnel-shaped sealing member located in a lower part of ink outlet 207. A sealing film 205 is provided to seal the exterior end of the ink outlet 207. The cap 202 is provided with an air vent and a ventilated plug 204 is employed to block the air vent. The ventilated plug 204 is preferably composed of cylindrical elements with air vent of 10~60 μm, which are made of polythene. The ventilated plug can allow the air to communicate with the ink chamber to keep a desired negative pressure within the ink chamber and can prevent the ink from polluting the environment when the ink cartridge is removed from the printer once being used, such as when the cartridge is inverted upon removal from the printer. The ventilated plug 204 is also sealed by the sealing film 205 as shipped from the manufacturer. Referring to FIG. 6, ink outlet 207 and the air vent are both sealed by the sealing film 205 and torn away when the ink cartridge is used. At the entrance of the valve socket 212, the ink passages 218 and 219 are connected to the ink outlet 207 and the ink passage 219 is provided in the exterior surface of the ink outlet 207. A sealing membrane 211 is used to seal ink passages 218 and 219.

Figure 7:
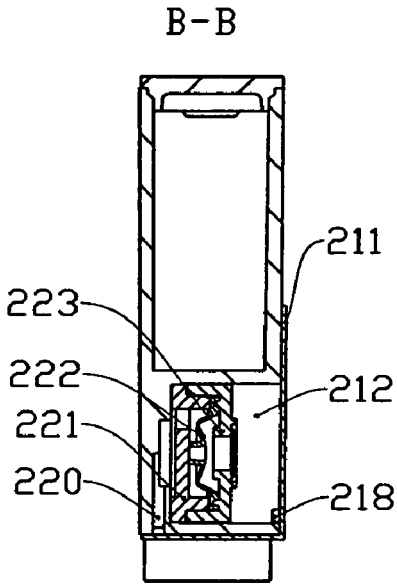
FIG. 7 is a cross-sectional view at a section taken along a line B-B of FIG. 5.

As shown in FIG. 7, at the left side of the valve socket 212 is an ink passage 220 connecting to the ink chamber for guiding ink therefrom, and at the bottom right side is an ink passage 218 connecting to ink outlet 207. The one-way valve unit assembly includes a pressing cover 221, bottom cover 223 and the valve 222. A trough is provided in the pressing cover 221 which is being maintained selectively in contact with the through hole of the valve 222. A through hole is provided in the central portion of the bottom cover 223. The valve unit assembly is engaged tightly with the valve socket.

Figure 8:
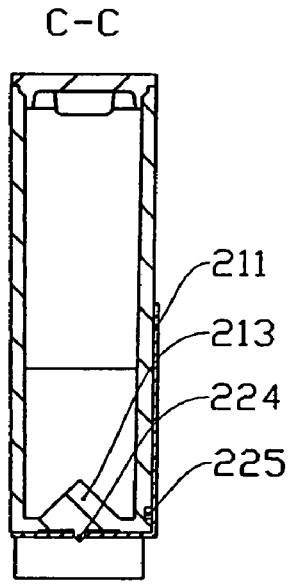
FIG. 8 is a cross-sectional view at a section taken along a line C-C in FIG. 5.

Referring to FIG. 8, an ink out detecting prism 213 is integrally formed with the bottom wall of the ink cartridge. The ink out detecting prism 213 projects inwardly toward the ink chamber and projects outward to form a rib 224 on the exterior surface of bottom wall. The sealing membrane 211 seals the ink passage 225 from the supplementary chamber 201 to the valve socket 212.

Embodiment Three

Figure 9:
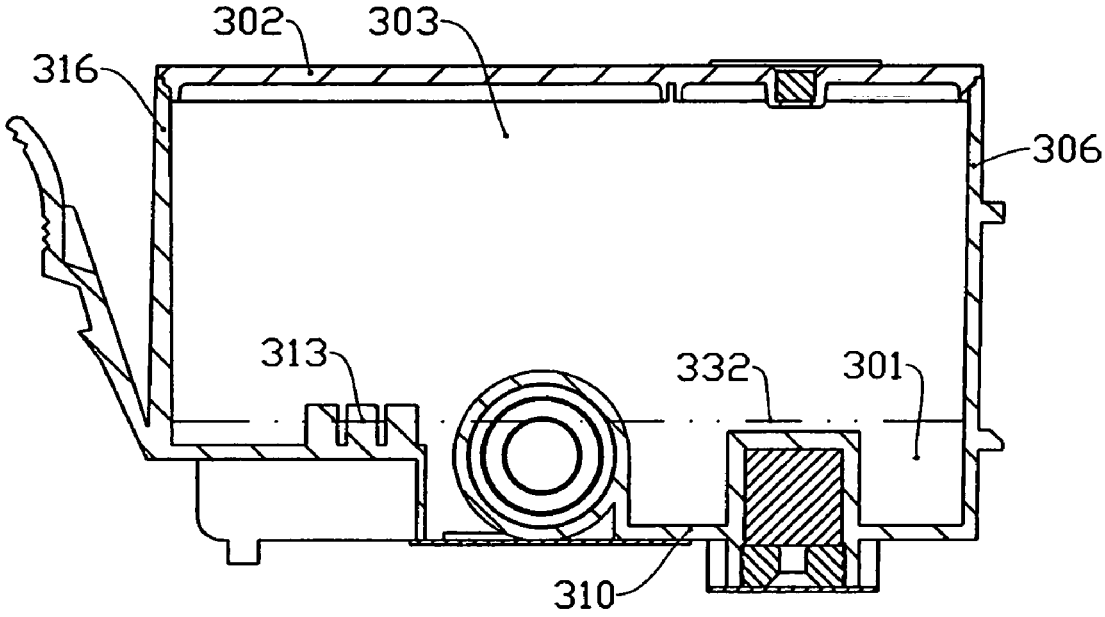
FIG. 9 is a sectional view showing the configuration of the ink cartridge of a third embodiment.

Referring to the embodiment of FIG. 9, the supplementary chamber is part of the main chamber, i.e., it is integrated therewith. The ink cartridge comprises a cap 302, two side walls 306 and 316, and bottom side 310. A supplementary chamber 301 is separated from the main chamber 303 by an invisible plane 332, which is the reflecting point of the ink out detecting prism 312. Thus, additional ink is provided from this supplemental volume located below the plane 332 once the ink out detecting prism signals that the ink cartridge is out of ink.

Figure 10:
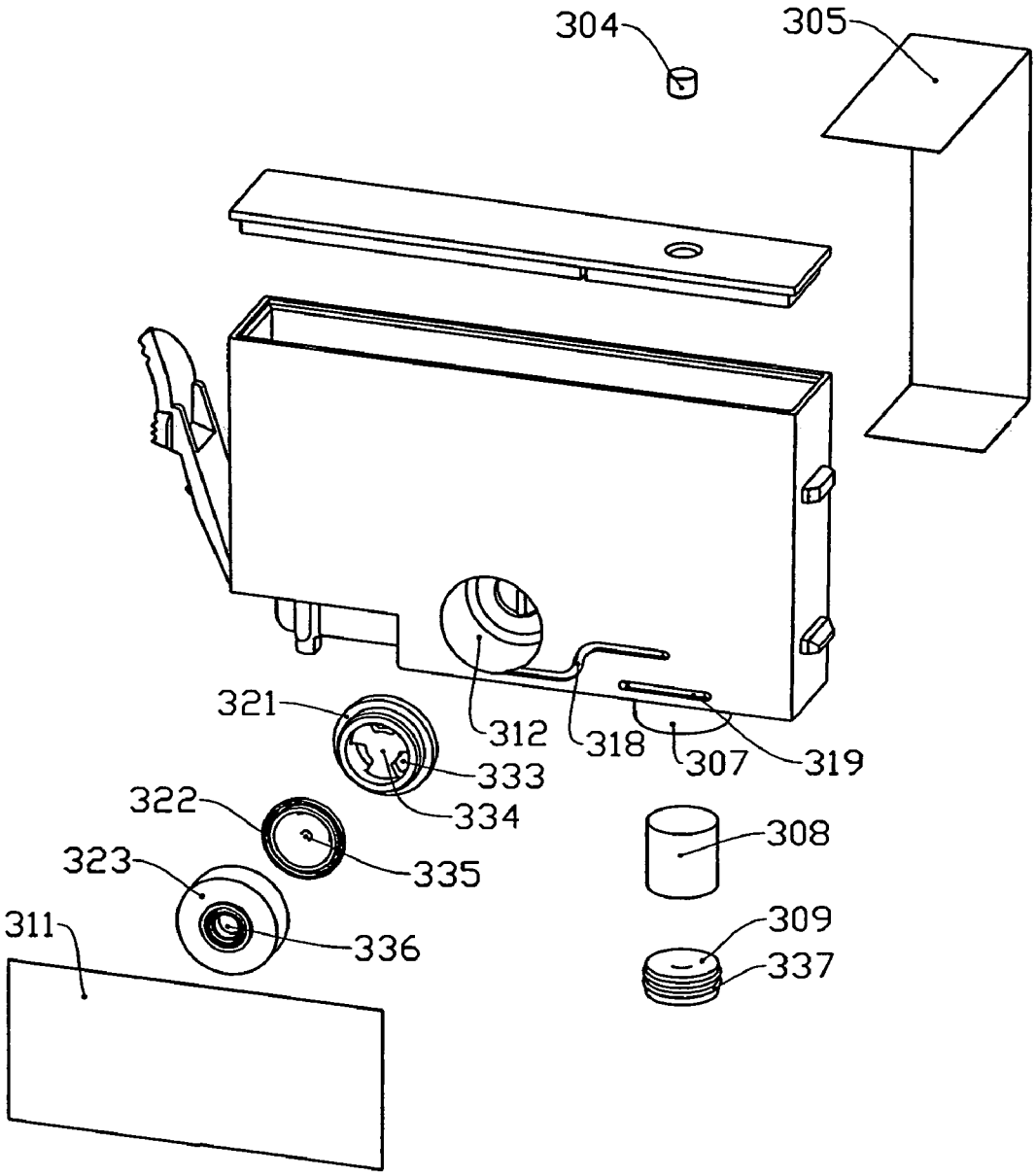
FIG. 10 is an exploded view showing the configuration of the ink cartridge of the third embodiment.

FIG. 10 shows the accessories and their assembly relations. A ventilated plug 304 is engaged tightly with the through hole in cap 302, and there are three troughs 333 in pressing cover 321. Through hole 335 of the valve 322 is engaged with the valve plane 334 at the central region of the pressing cover 321, and a through hole 336 is provided in the middle of bottom cover 323. After the one-way valve is loaded or assembled in the valve socket 312, the sealing membrane 311 seals the process hole in the valve socket and ink passages 318 and 319. The fiber 308 is engaged tightly with ink outlet 307. The sealing member 309 is provided with two hoops or circumferentially continuous protrusions to seal tightly with the ink outlet 307. The sealing membrane 305 seals the air vent and ink supply port 307 and is torn away or removed before the ink cartridge is used.

Embodiment Four

Figure 11:
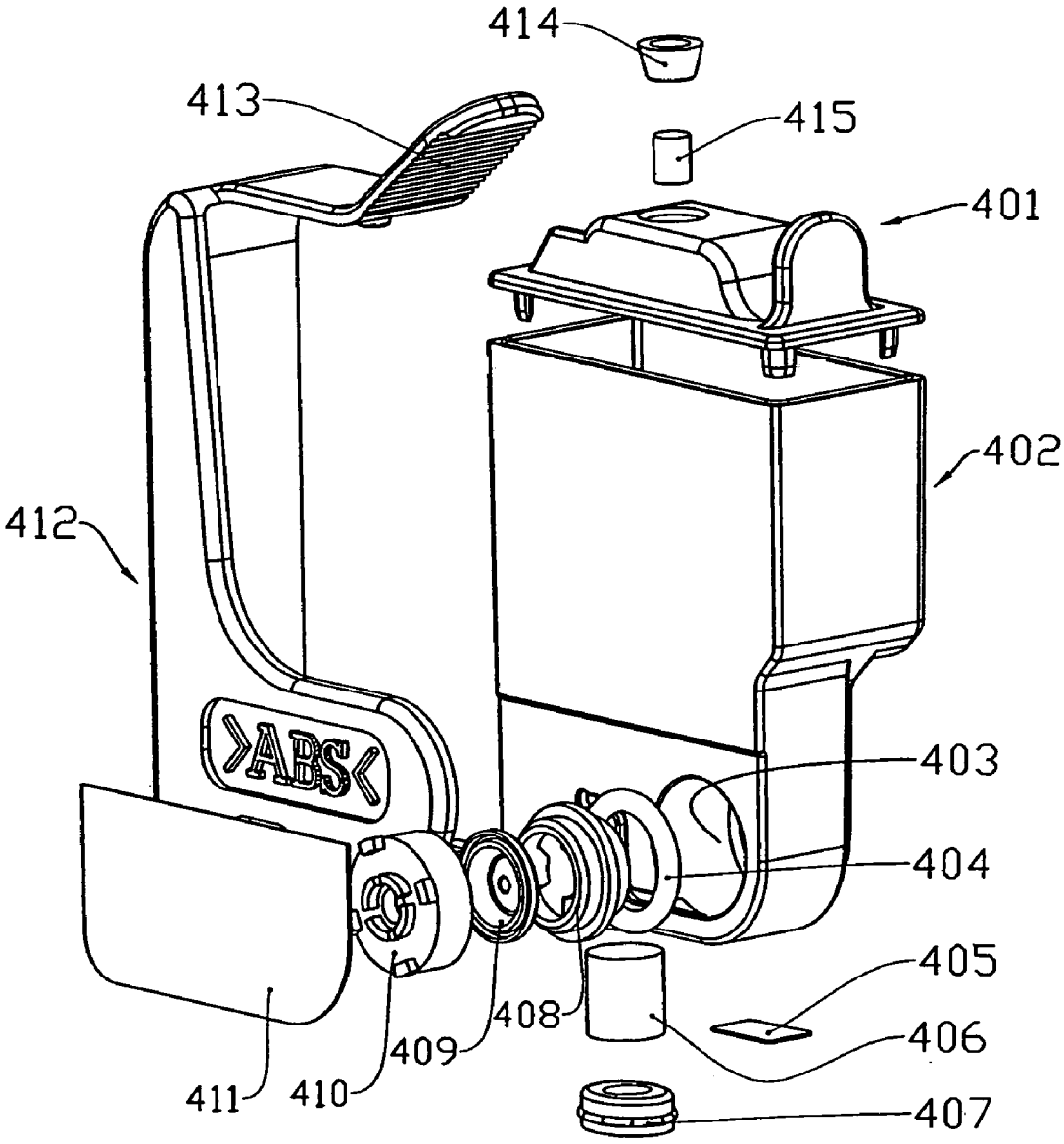
FIG. 11 is an exploded view showing the configuration of the ink cartridge of a fourth embodiment.

Referring to FIG. 11, this embodiment is a single-color ink cartridge. Cartridge body 402 comprises an ink chamber and a cap 401 welded with cartridge body 402. In a lower portion of cartridge body 402 is a valve socket 403 that receives the one-way valve unit assembly that includes bottom cover 410, pressing cover 408 and the valve 409. Preferably, the valve unit assembly is loaded into valve socket 403 by employing a sealing member 404 that seals about a periphery of the valve unit assembly when it is mounted in the valve socket. Sealing membrane 411 is used to seal valve socket 403 and a groove or passage connected to outlet of the valve. Ink guiding member 406 is a fiber made of hydrophilic material, i.e., having an affinity for absorbing water, such as polypropylene, polythene, or fibrin and alternative materials that serve the same function, which is loaded into ink outlet at the bottom of the ink cartridge. A sealing member 407 is disposed outside the ink guiding member 406. A sealing membrane 405 covering a groove/passage connected to the entrance of the one-way valve unit is provided at the bottom of the cartridge body 402. A picking member or deflectable lever arm 413 is provided on the protective cover and facilitates loading and unloading the ink cartridge in a protecting cover 412. A stopper 415 is a ventilated and water proof porous member made of macromolecule material such as terylene, polypropylene, polythene or similar material, which is inserted into the air vent in cap 401. When the ink cartridge is covered with the protecting cover 412, the vent sealing 414 on the protecting cover 412 will seal the air vent.

Figure 12:
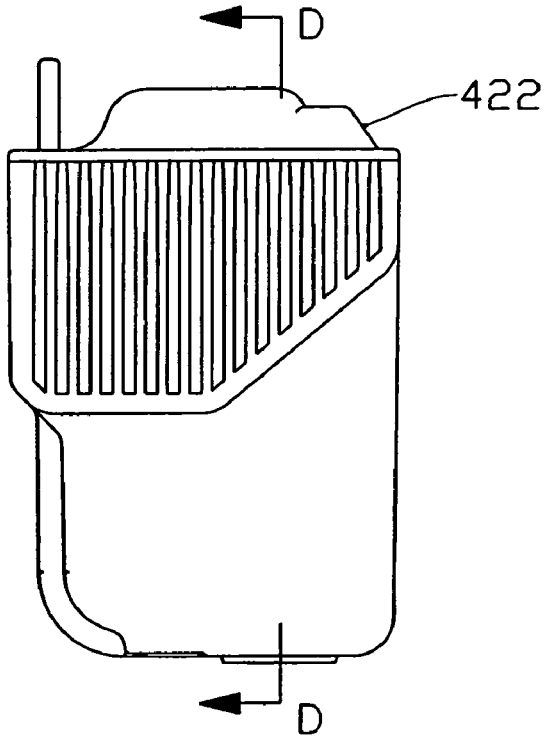
FIG. 12 is a front view of the fourth embodiment.
Figure 13:
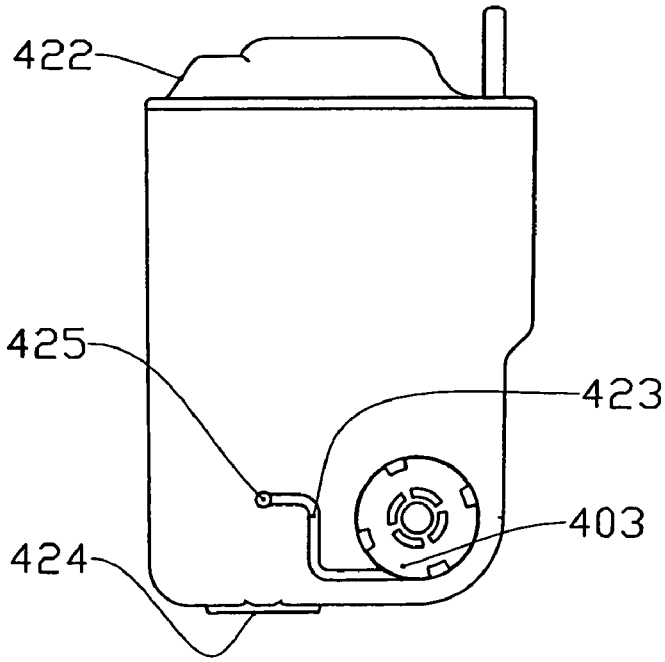
FIG. 13 is a rear view of FIG. 12.

Referring to FIG. 12 and FIG. 13, a row of localized bulges or ridges 422 lies at the cap of the ink cartridge, and a groove or passage 423 is located in the exterior of the ink cartridge. One end 425 of the groove 423 enters into an upper portion of the ink outlet 424, and the other end of the passage enters into the valve socket 403 of the one-way valve.

Figure 14:
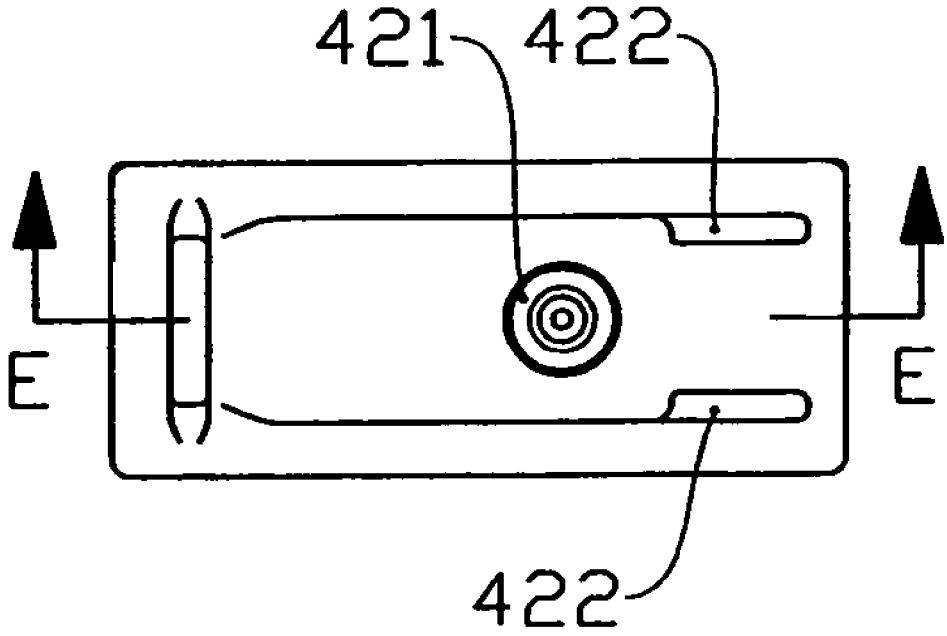
FIG. 14 is a top view of FIG. 12.

Referring to FIG. 14, air vent 421 lies in top of the cap of the ink cartridge, and two of localization bulges or ridges 422 having a sloped surface are illustrated.

Figure 15:
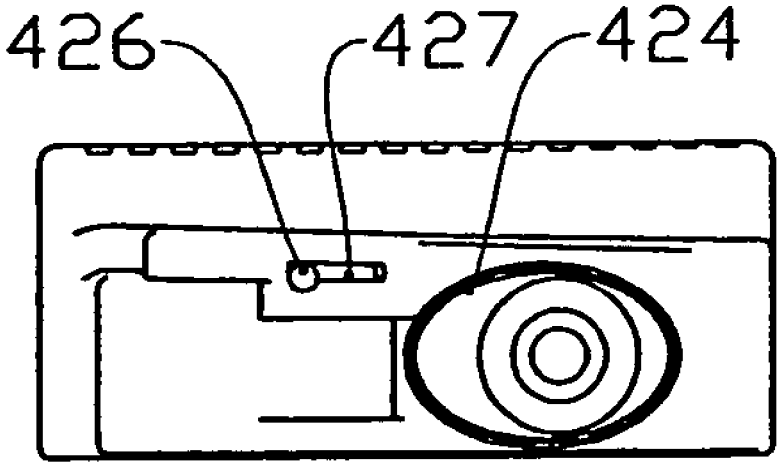
FIG. 15 is a bottom view of FIG. 12.

Referring to FIG. 15, another groove 427 is provided in the exterior of the bottom of the ink cartridge, with one end 426 entering into valve socket, and the other end entering into the ink chamber. This figure also illustrates how the ink outlet 424 changes slowly from a circle to an ellipse as the ink outlet proceeds from the interior to the exterior.

Figure 16:
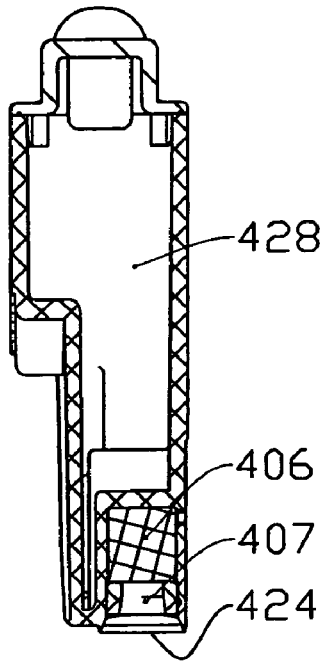
FIG. 16 is a cross-sectional view at a section taken along a line D-D of FIG. 12.

Referring to FIG. 16, although the ink outlet 424 lies below the ink chamber 428, the ink outlet is not connected directly to the ink chamber 428, and rather is connected to ink chamber via the one-way valve unit and an ink passage. In addition, an ink guiding member 406 and a sealing member 407 are disposed within the ink outlet 424.

Figure 17:
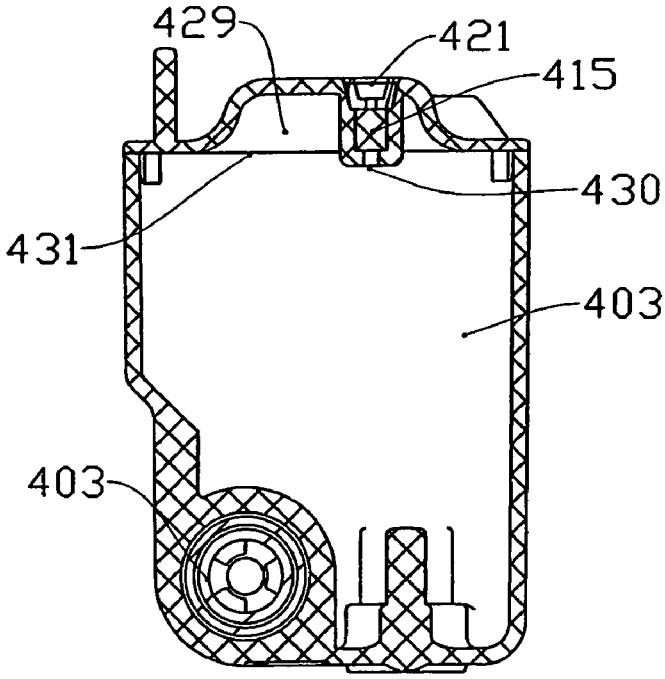
FIG. 17 is a cross-sectional view at a section taken along a line E-E of FIG. 14.

Referring to FIG. 17, a stopper 415 is loaded into the air vent 421 in the cap of the ink cartridge and allows air to vent therethrough while preventing fluid (e.g., ink) from passing therethrough. An inverted concave chamber 429 is formed surrounding the air vent 421, and vent port 430 is formed in the interior end of the air vent 421 and is designed to be located below the bottom plane 431 of the concave chamber 429. Although the valve socket 403 is inside of the ink cartridge, the valve socket is not connected directly to the ink chamber 428, and instead is connected by the ink passage that includes groove 427 and the sealing membrane 405.

Embodiment Five

Figure 18:
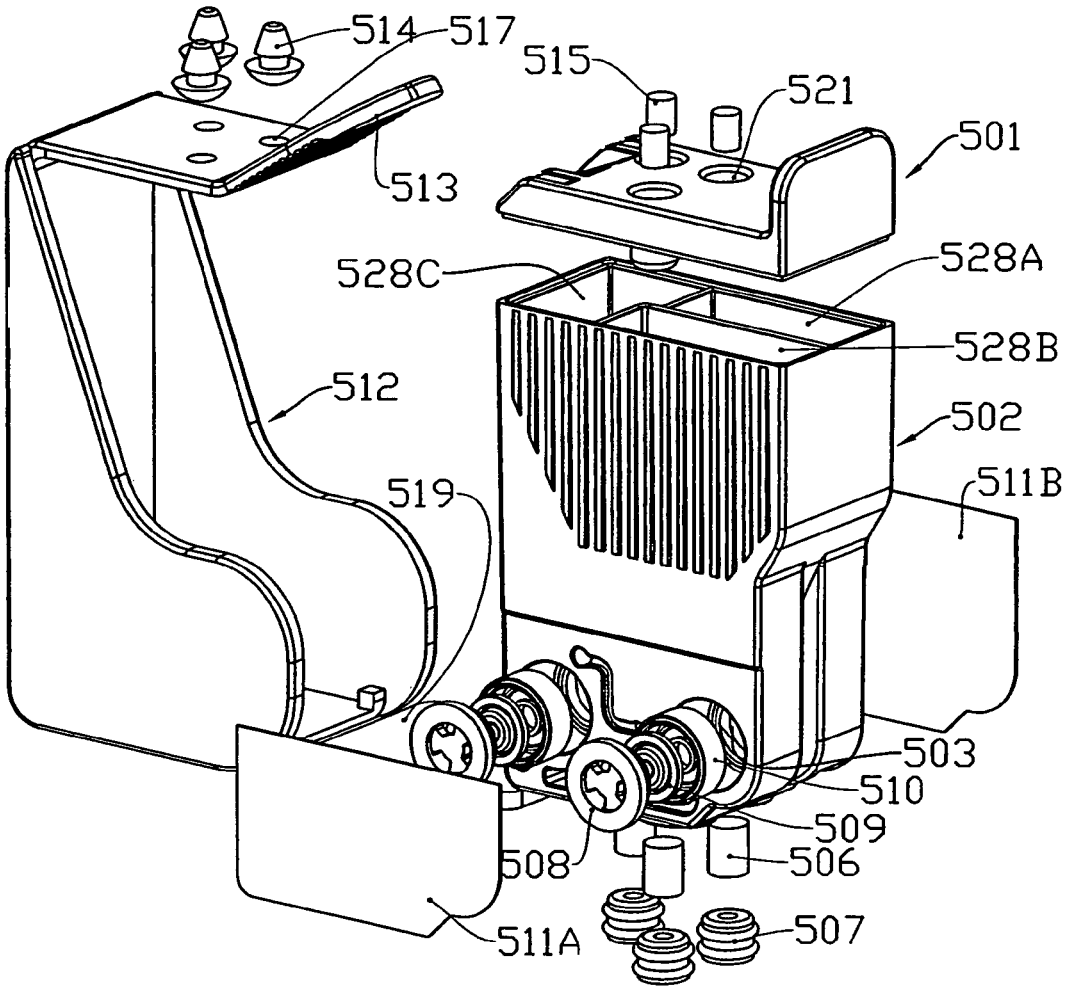
FIG. 18 is an exploded view showing the ink cartridge of a fifth embodiment.

Referring to FIG. 18, this embodiment relates to a three-color ink cartridge, i.e., the cartridge body 502 comprises three independent ink chambers 528A, 528B and 528C. There is an air vent 521 with a ventilated and waterproof stopper 515 relative to each ink chamber in the cap 501; three valve sockets 503 and two sealing membranes 511A and 511B are disposed in side walls of the cartridge body 502. The one-way valve unit assembly includes bottom cover 510, a cap 508 and valve 509; an ink guiding member 506 and a sealing member 507 are disposed in each of three ink outlets. On the top of the protecting cover 512 are three openings or holes 517 corresponding to or located for mating relation with air vents 521; a sealing member 514 made of rubber is positioned in each of the holes 517; a picking member or flexible lever 513 is provided on the top of the protecting member 512; and at the bottom there is an ink outlet sealing member 519, which seals the three ink supply ports when the ink cartridge is loaded in the protecting member 512. The material and configuration of the accessories not mentioned in this embodiment are the same as the ones in the fourth embodiment.

Figure 19:
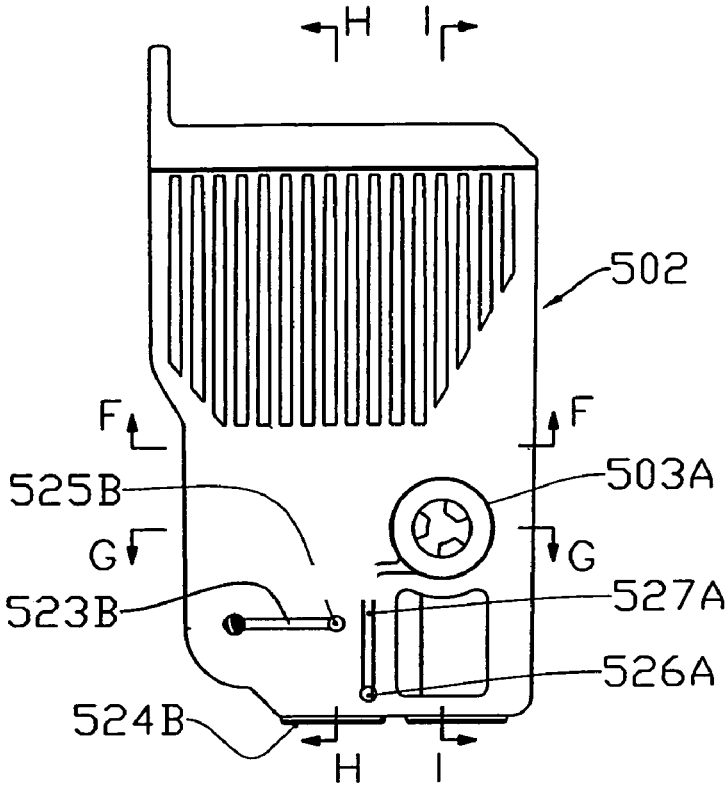
FIG. 19 is a front view showing the ink cartridge of the fifth embodiment.

Referring to FIG. 19, a valve socket 503A is formed in the side of the cartridge body 502. One end 526A of groove 527A enters into ink chamber 528A (FIG. 22), and the other end is connected to valve socket 503A. One end 525B of the groove 523B enters into the upper portion of the ink outlet 524B, and the other end is connected to valve socket 503B in the other side of the cartridge body 502.

Figure 20:
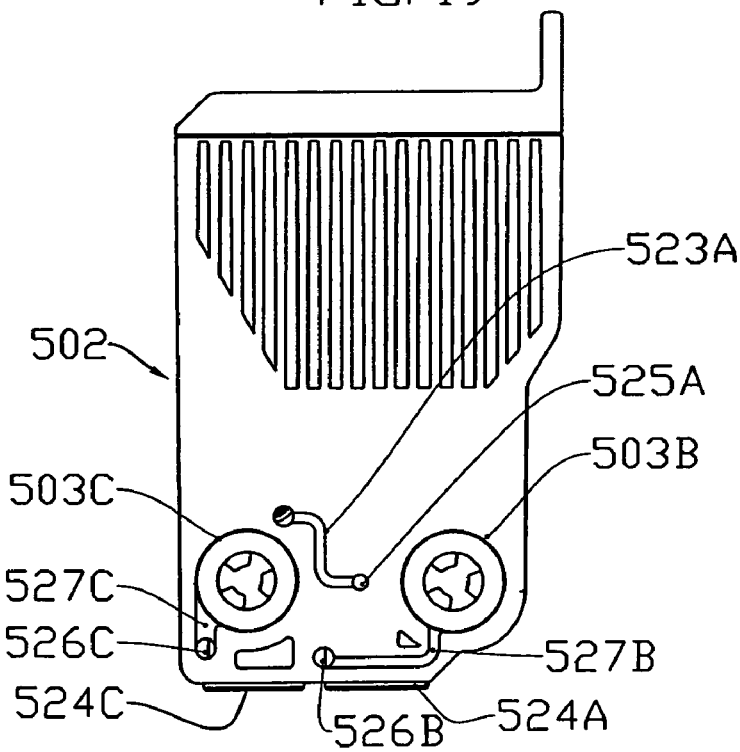
FIG. 20 is a rear view of FIG. 19.

Referring to FIG. 20, cartridge body side 502 is provided with two valve sockets 503B and 503C. One end 525A of the groove 523A enters into the upper portion of the ink outlet 524A, and the other end is connected to valve socket 503A in the other side of the cartridge body 502. One end 526B of the groove 527B enters into ink chamber 528B, and the other end is connected to 503B; and one end 526C of the groove is connected to ink chamber 528C, and the other end is connected to valve socket 503C.

Figure 21:
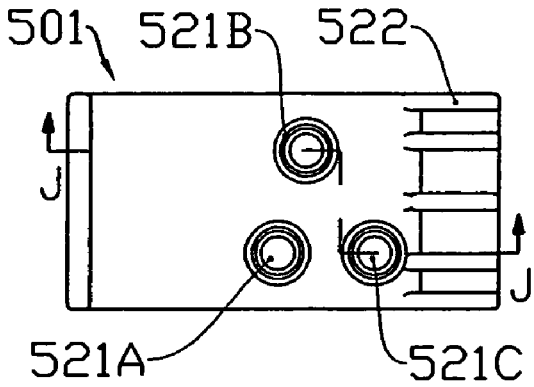
FIG. 21 is a top view of FIG. 19.

Referring to FIG. 21, three air vents 521A, 521B, and 521C in the cap 501 are connected to three ink chambers respectively. There are five localization bulges or ridges 522 having a sloped surface.

Figure 22:
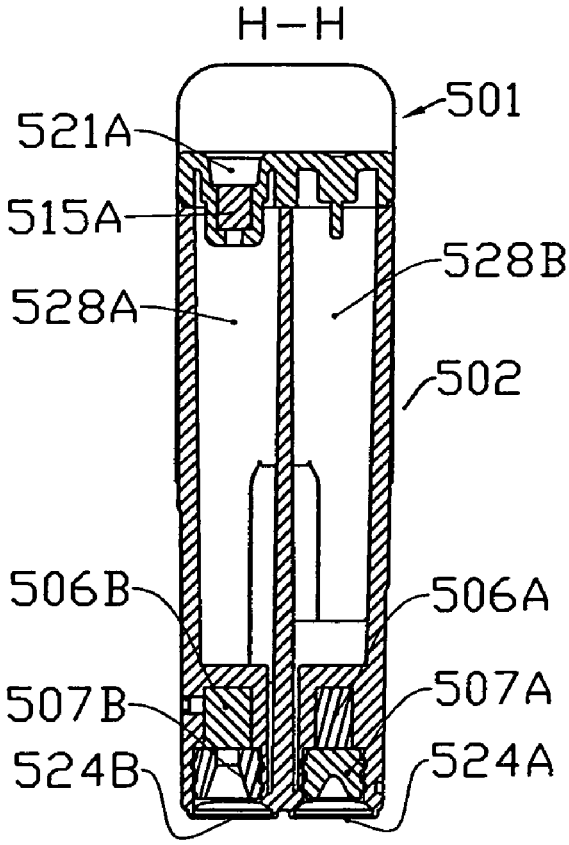
FIG. 22 is a cross-sectional view at a section taken along a line H-H of FIG. 19.

Referring to FIG. 22, it can be seen from this sectional view that two separate ink chambers 528A and 528B are formed after top 501 and cartridge body 502 are joined or fused together such as by ultrasonic welding. The air vent 521A has stopper 515A that allows air to pass therethrough but precludes passage of ink from the ink chamber 528A. It can be also seen that ink outlets 524A and 524B, respectively, with ink guiding members 506A and 506B, and sealing members 507A and 507B, are not connected directly to corresponding ink chambers 528A and 528B. To facilitate removal of the cartridge body from the mold when being made, the ink supply port is not located directly below the corresponding ink chamber, and is instead arranged crosswise as shown in FIG. 21.

Figure 23:
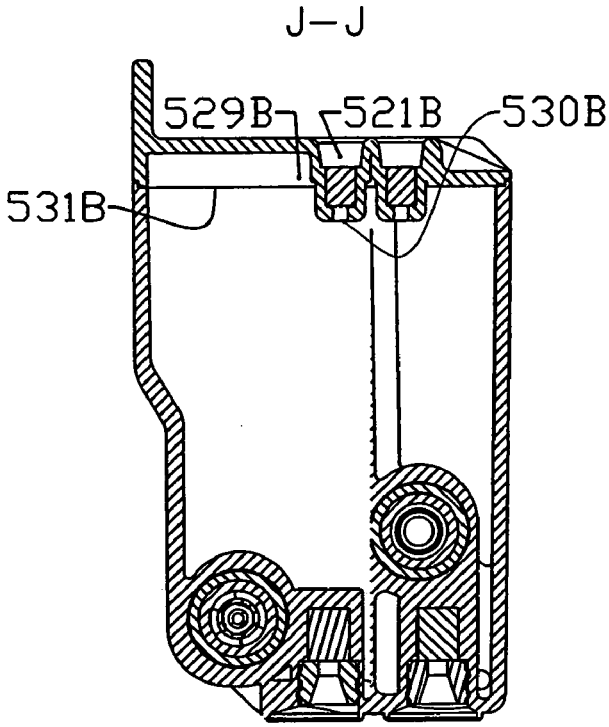
FIG. 23 is a cross-sectional view at a section taken along a line J-J of FIG. 21.

Referring to FIG. 23, it can be seen that the vent port 530B of air vent 521B is below the bottom plane 531B of inverted concave chamber 529B in the ink chamber 528B.

Figure 24:
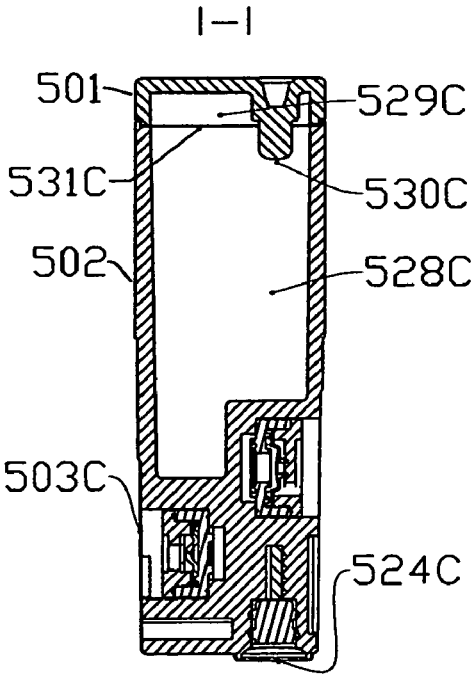
FIG. 24 is a cross-sectional view at a section taken along a line I-I of FIG. 19.

Referring to FIG. 24, likewise, an inverted concave chamber 529C is provided in the ink chamber 528C in the cap 501, and the port 530C of the air vent in this region is below the bottom 531C of inverted concave chamber 529C. The valve socket 503C and ink outlet in this chamber 528C are all in the lower portion. These components are connected by the ink passage, formed by the holes in the inside wall of cartridge body 502, a groove in the exterior wall and a sealing membrane.

Figure 25:
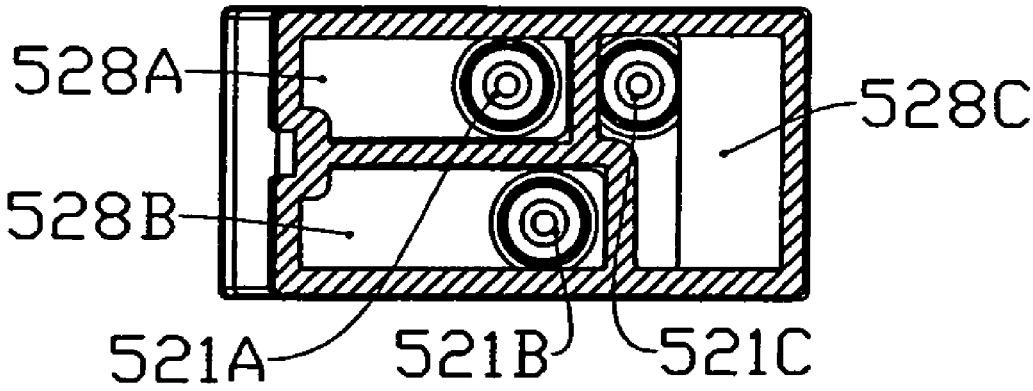
FIG. 25 is a cross-sectional view at a section taken along a line F-F of FIG. 19.

Referring to FIG. 25, a preferred arrangement of three independent ink chambers 528A, 528B and 528C, and air vents 521A, 521B and 521C can be seen.

Figure 26:
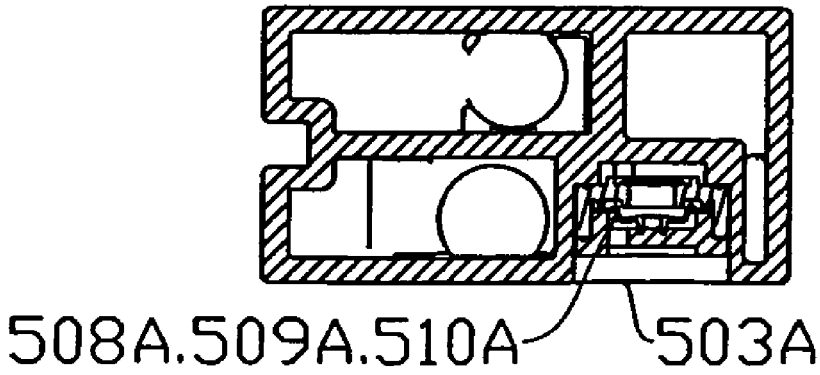
FIG. 26 is a cross-sectional view at a section taken along a line G-G of FIG. 19.

Referring to FIG. 26, after the one-way valve unit assembly is assembled with bottom cover 510A, pressing cover 508A and the valve 509A, the assembly is set in valve socket 503A and its circumference is welded to secure the assembly therein.

Figure 27:
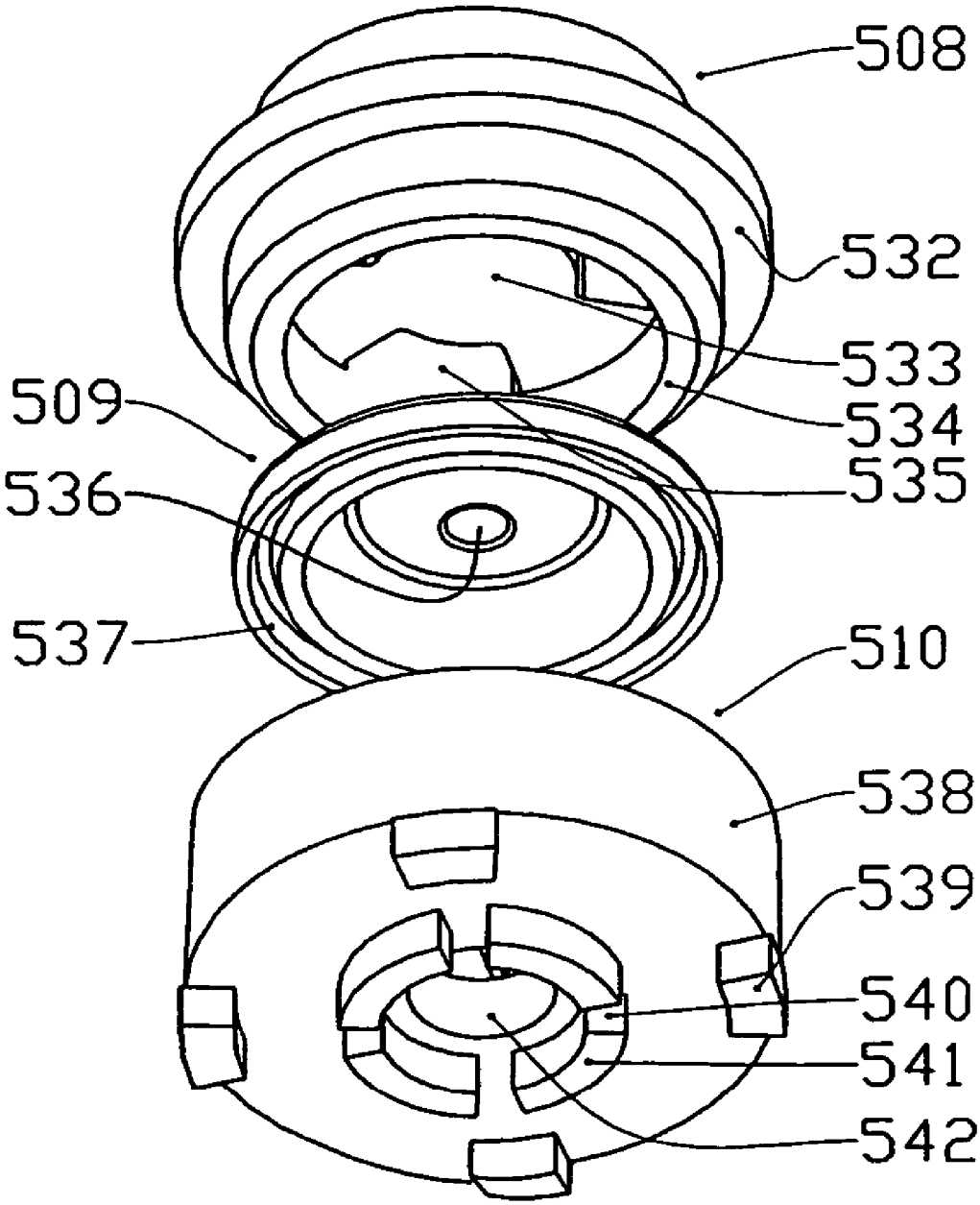
FIG. 27 is an exploded view showing the one-way valve unit assembly.

Referring to FIG. 27, pressing cover 508 is a molded plastic member. On the outside, there is a flange whose bottom surface 532 is used for welding with bottom cover 510. In addition, the pressing cover defines a valve plane 533, includes three entrances or through passages 535 and a press ring 534 for fixation of the valve. The head support portion of the elastic valve 509 has a through hole 536 that selectively contacts elastically and tightly with valve plane 533, and a circumference 537 that is extruded and generally fixed. The bottom cover 510 is a molded plastic member, comprising a ring 538 adapted to be welded with the valve socket, an outlet 542, protrusions 539 (four illustrated here) formed on the end of outlet 542 and protruding ring 541 surrounding outlet 542, which is of same height as protrusion 539 and has multiple passages, shown here as four groove ports 540. When assembled together, these three components form a highly useful one-way valve unit assembly that finds particular application in the ink cartridge environment as illustrated and described herein.

Embodiment Six

Figure 28:
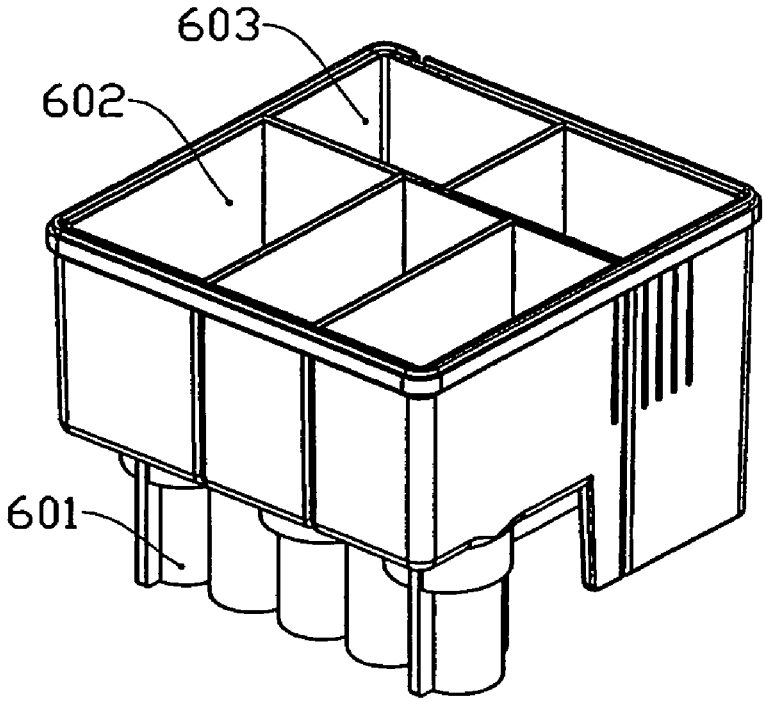
FIG. 28 is a perspective view showing the ink cartridge with the cover removed.

Referring to FIG. 28, multiple ink outlets 601 are dimensioned for engagement with the printer (not shown) and lie in a side of the substantial hexahedron. In this embodiment, five ink chambers are composed by three longitudinal partition members and a transverse partition member, and the five ink chambers are arranged as two rows, three ink chambers 602 are in the front row and two ink chambers 603 are in the rear row.

Figure 29:
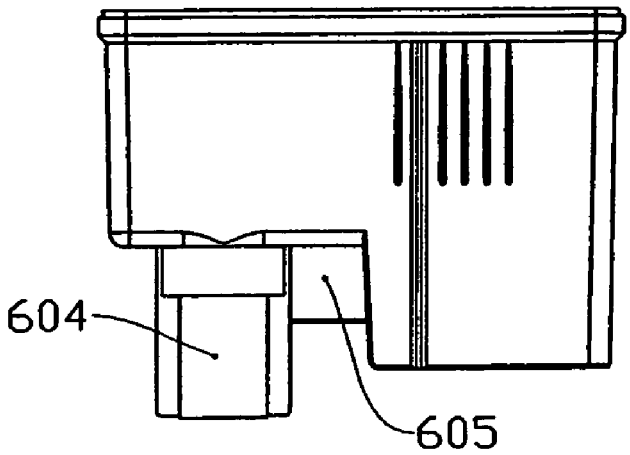
FIG. 29 is a front view of FIG. 28.

Referring to FIG. 29, it can be seen that longitudinal ink supply tubes 604 are connected to the ink chambers in the front row, and transverse ink supply tubes 605 are connected to the ink chambers in the rear row.

Figure 30:
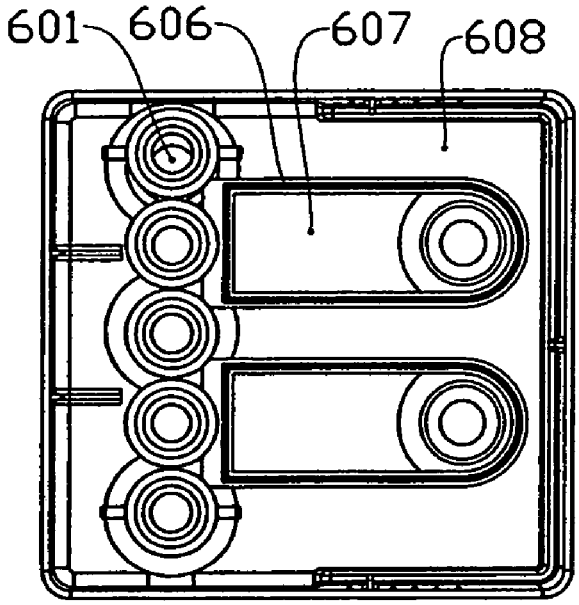
FIG. 30 is a bottom view of FIG. 28.

Referring to FIG. 30, the cover for covering the transverse ink supply tube has been removed and is not shown. The inner chamber 607 in the ink supply tube is surrounded by wall 606 at the bottom 608 of the ink cartridge. One end of the inner chamber 607 contains a valve socket for holding a one-way valve unit assembly, and the other end extends to a position near ink outlet 601.

Figure 31:
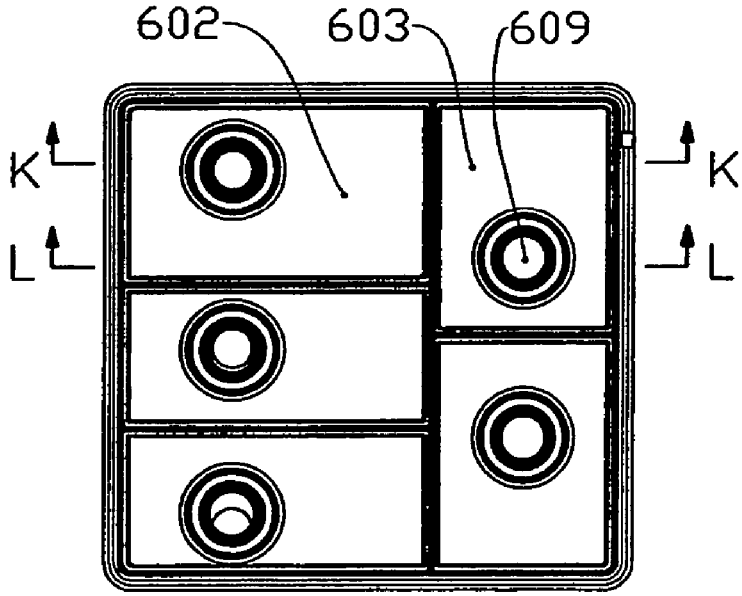
FIG. 31 is a top view of FIG. 28.

Referring to FIG. 31, the arrangement of the ink chambers 602 and 603 and the valve socket 609 in each chamber can be seen clearly.

Figure 32:
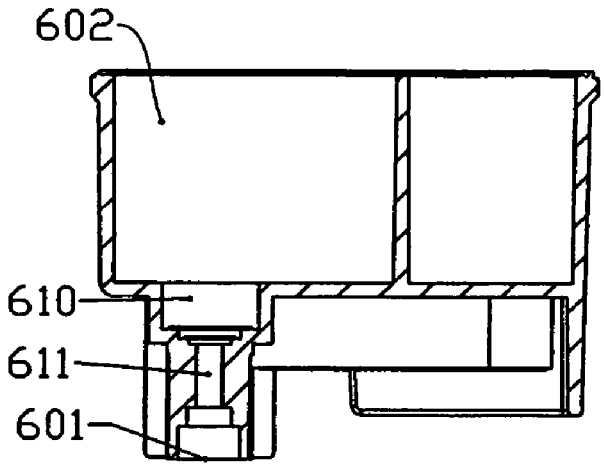
FIG. 32 is a sectional view taken along a line K-K of FIG. 31.

FIG. 32 shows the configuration of the ink chamber 602 in the front row. At a bottom of the ink chamber 602 is provided valve socket 610, ink supply tube 611, and ink supply port 601 proceeding from the interior to the exterior which are in fluid communication and together constitute an ink supply passage.

Figure 33:
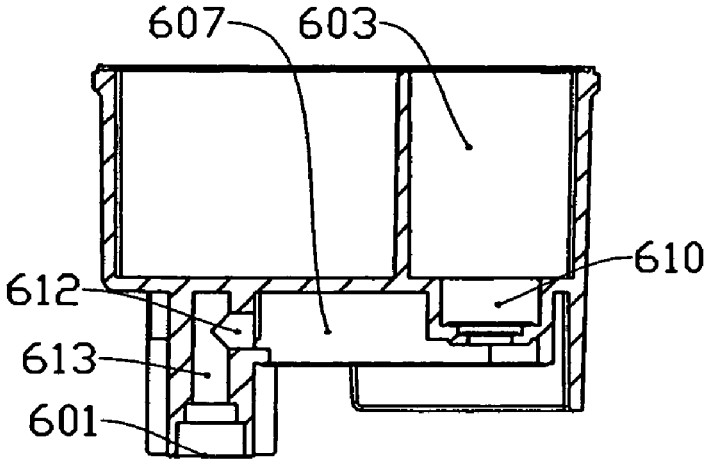
FIG. 33 is a cross-sectional view at a section taken along a line L-L of FIG. 31.

FIG. 33 shows the configuration of the ink chamber 603 in the rear row. At a bottom of the ink chamber 603 is provided valve socket 610, ink supply tube, and ink outlet 601 proceeding from the interior to the exterior which are in fluid communication and together constitute an ink supply passage. A difference between ink chamber 603 and the ink chamber 602 is that the ink supply tube in ink chamber 603 is divided into two parts, one part being horizontal part composed of inner chamber 607, and the other being vertical part composed of inner part 613. The two parts are connected by opening or hole 612.

Embodiment Seven

Figure 34:
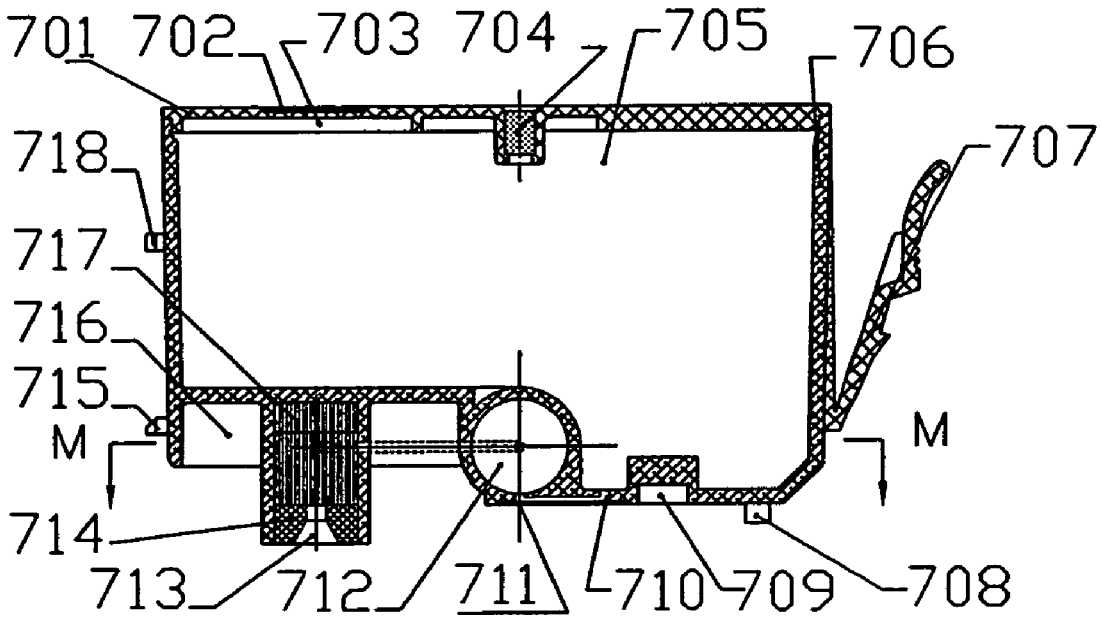
FIG. 34 is a sectional view showing the ink cartridge in a seventh embodiment.

Referring to FIG. 34, the cartridge body includes cap 701 and cartridge 706. At ink outlet 713 there is a sealing member 714 provided at the bottom of ink chamber 705. An air vent 703 is provided in the cap 701 and connects the air with the ink chamber 705. A valve socket 712 lies between two side walls 716 and ink passage 710 is a low-position tube composed of a groove in the exterior of the bottom of the ink cartridge and a sealing membrane 711; so that the ink in the ink chamber 705 enters into valve socket 712 passing ink passage 710 and reaching the entrance to the one-way valve unit assembly. The ink supply tube is divided into two parts, one part is connected to vertical part of ink outlet 713, i.e. the tube holding fiber member 717 and sealing member 714; and the one-way valve unit assembly is fixed vertically at the side of the socket 712. In FIG. 34, the stopper 704 is for sealing the ink filling port; ventilated sealing membrane 702 is made of water proof material for sealing air vent 703 against ink leakage but allowing air to flow therethrough, guaranteeing that the negative pressure value in ink chamber remains substantially constant, and at the same time, preventing ink from leaking or evaporating from air vent 703. The flexible lever 707, having an integral locking member on it, and the locking members 715, 718 at the opposite side of the ink cartridge are used for mounting or fixing the ink cartridge. The positioning member 708 further cooperates with the ink cartridge holder to ensure the operation of ink out detecting apparatus.

Figure 35:
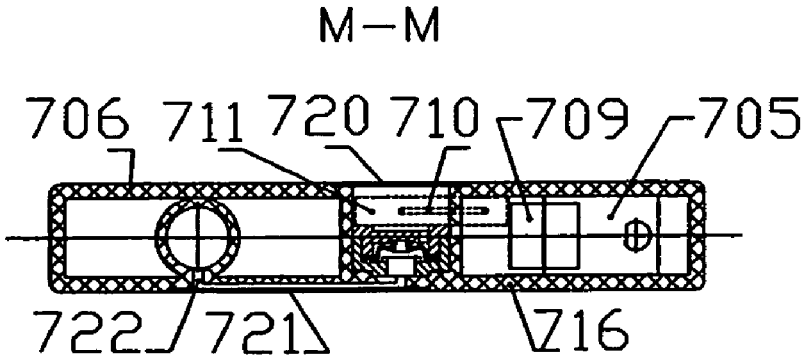
FIG. 35 is a cross-sectional view at a section taken along a line M-M of FIG. 34.

Referring to FIG. 35, a valve socket 711 includes an ink passage 710 to ink chamber 705 disposed at the bottom and separated from the ink cartridge 706. The one-way valve unit assembly is received or set in a hole in a side wall of the ink cartridge and contacts tightly with another side wall 716 of the cartridge. The hole is sealed by sealing membrane 720 after the one-way valve unit assembly is received in the hole. An ink out detecting prism 709 protruding to an interior of the ink chamber 705 lies at the bottom of the ink chamber 705. There is a groove connecting the one-way valve unit assembly with the vertical part of ink supply tube in the exterior of the side wall 716, and the groove and sealing membrane 721 constitute the horizontal part of the ink supply tube 722.

Figure 36:
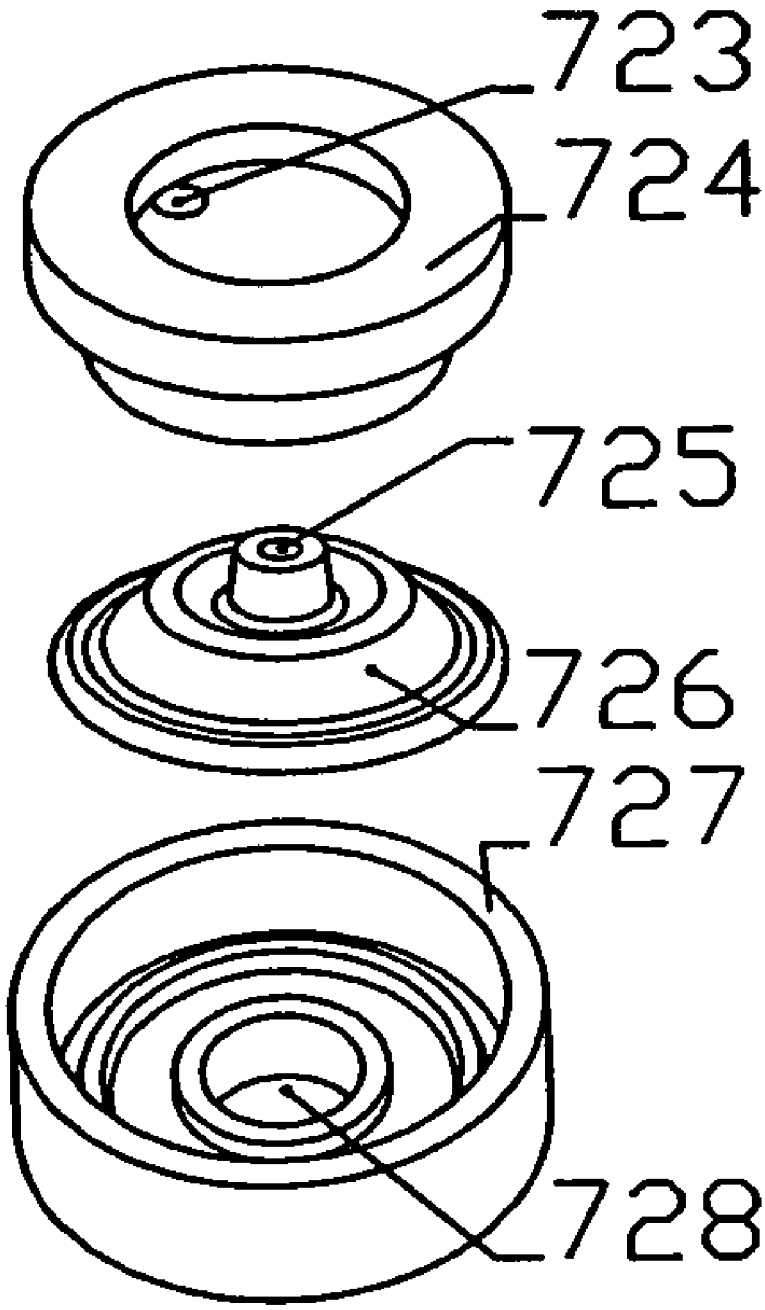
FIG. 36 is an enlarged exploded perspective view showing the one-way valve unit assembly.

Referring to FIG. 36, the one-way valve unit assembly comprises pressing cover 724, valve 726, and bottom cover 727. The circumference 726 of the valve is pressed tightly between pressing cover 724 and bottom cover 727. A through hole 725 selectively contacts tightly with the valve plane on an underside of the cap 724 to shut off or cut off the ink passage when the valve is closed. When ink is consumed to a certain level, the negative pressure in the tube will make or urge the valve 726 to move downwards, that is, the through hole 725 will leave the valve plane defined on the underside of the pressing cover 724 and, therefore, ink in the ink chamber will enter into ink supply tube passing in order through the through hole 723 in the pressing cover 724, the through hole 725 in the valve 726, and the through hole 728 in the bottom cover 727, and the one-way valve assembly is opened. Except when ink is supplied as described above, the through hole of the valve 725 will contact tightly with the valve plane depending on its elasticity and the one-way valve assembly is closed.

Embodiment Eight

Figure 37:
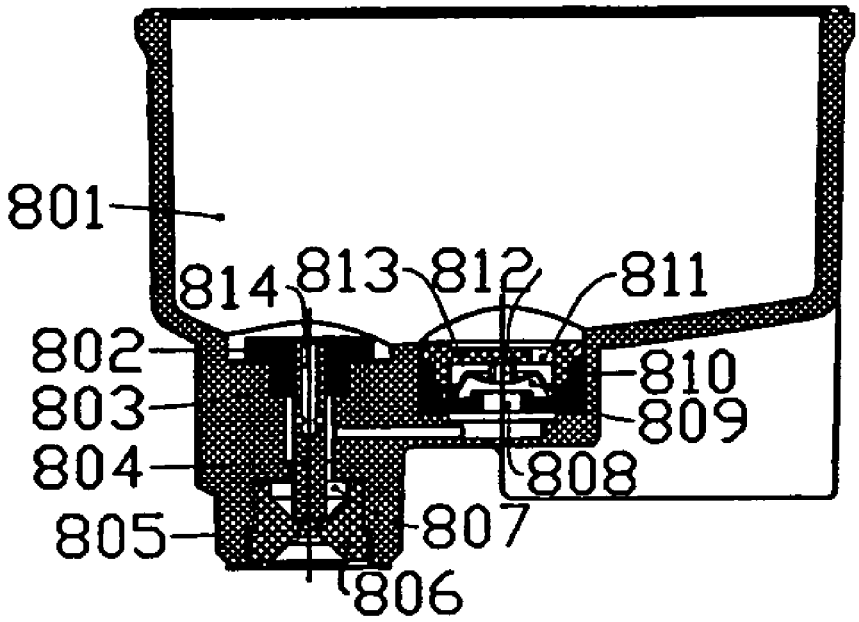
FIG. 37 is a sectional view showing the ink cartridge of an eighth embodiment.
Figure 38:
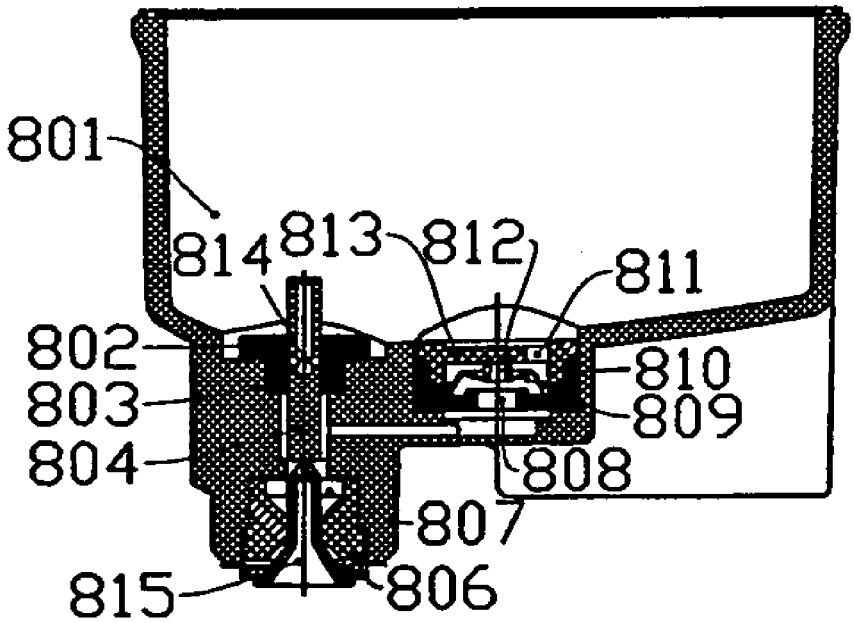
FIG. 38 is a sectional view showing the ink supplying status of the eighth embodiment.

Referring to FIG. 37 and FIG. 38, a sealing member 806 is disposed in ink outlet; a block 805 is connected with sealing member 806 by a very thin ring membrane; and a one-way valve unit assembly is positioned between ink chamber 801 and ink outlet. The one-way valve unit assembly comprises a bottom cover 810 with a through hole 808, the valve 809 with a through hole 812 and a pressing 813 with a through hole 811. The head portion with through hole 812 contacts tightly with the valve plane of the pressing cover 813 depending on the elasticity of the valve 809 which is preferably made of elastic material. The space between the valve plane and block 805 is an ink supply chamber 807. There is an idle body 804 at the axis of the ink supply needle 815 as shown in FIG. 37, engaging with a gap in a bushing 802. The sealing member 803 guarantees the sealing between idle body 804 and bushing 802 when the idle body 804 moves in an axial direction relative to bushing 802. The idle body 804 should be of same sectional area, i.e., maximum outer diameter, as the ink supply needle 815, in order that one can be replaced for the other upon insertion of the ink cartridge on the printer. A passage 814 is also selectively displaced when the idle body member is displaced by the printer needle (compare location of passage 814 in FIG. 37 with FIG. 38) and is located between a part of the idle body 804 in ink chamber 801 and a middle part, connecting ink chamber with ink supply chamber when ink supply needle is not inserted in. From the point of view of the technology of ink cartridge manufacture, it is convenient for ink to be filled into the two chambers under same pressure. Obviously, the passage 814 can be replaced with the grooves in the exterior side of the idle body as an alternative construction. When ink supply needle 815 is pierced into sealing member 806, the ring membrane breaks, block 805 breaks off, and ink supply needle 815 pushes idle body 804 upwardly out of the ink supply chamber 807. At the same time, passage 814 is blocked off from ink supply chamber 807 by sealing member 803 and becomes a blind or dead end passage.

Embodiment Nine

Figure 39:
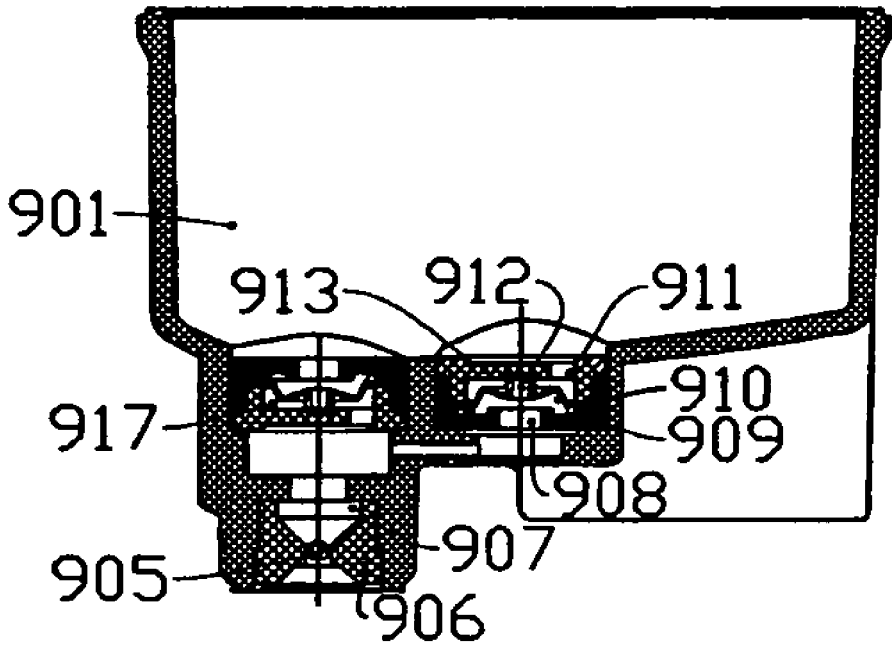
FIG. 39 is a sectional view showing the ink cartridge of a ninth embodiment.

Referring to FIG. 39, a sealing member 906 is positioned or set in an ink outlet. A block 905 is connected with sealing member 906 by a very thin ring membrane and a one-way valve unit assembly is located between ink chamber 901 and the ink outlet. The valve unit assembly comprises a bottom cover 910 with a through hole 908, the valve 909 with a through hole 912, and a pressing cover 913 with a through hole 911. The head portion of through hole 912 contacts tightly with the valve plane of the pressing cover 913 depending on the elasticity of the valve 909 which is made of elastic material. The space between the valve plane and sealing member 906 is defined in this embodiment as the ink supply chamber 907. There is a passage for discharging pressure between ink chamber 901 and ink supply chamber 907, in which a one-way valve 917 discharging pressure is set inversely, i.e., the valve will open only when the pressure in the ink supply chamber 907 reaches or exceeds a predetermined value which should be lower than 0.3 times of the pressure value that could damage print head, or else, the valve will close. The configuration of the valve 917 is substantially the same as the one-way valves described in the other embodiments except for the predetermined value parameter. It can be seen from the drawing that the bottom cover 910 of one valve is facing upward and the other is facing downward. It is obvious that they can be exchanged with each other relative to the ink cartridge.

Embodiment Ten

Figure 40:
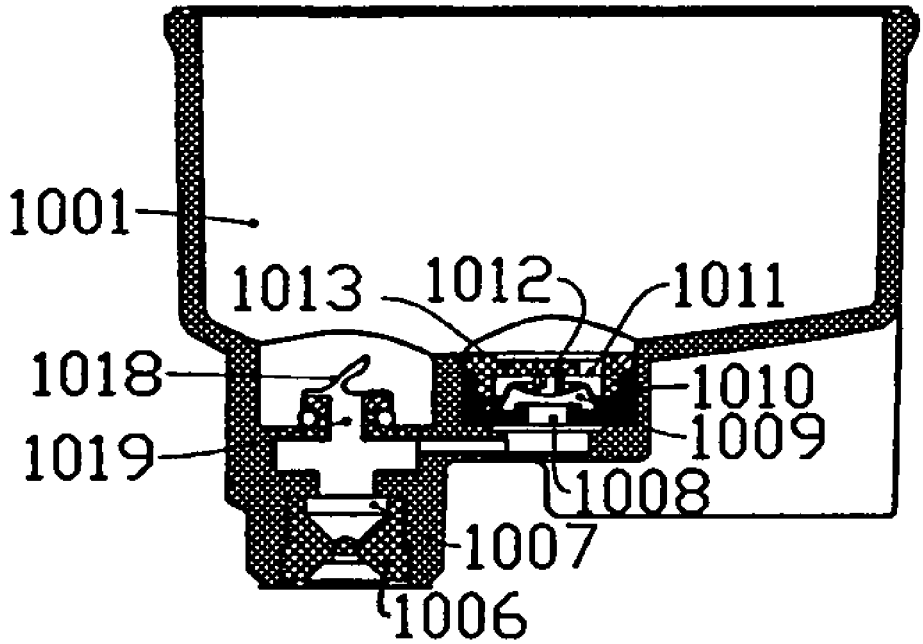
FIG. 40 is a sectional view showing the ink cartridge of a tenth embodiment.

Referring to FIG. 40, a sealing member 1006 is secured or set in ink outlet and a block is connected with the sealing member 1006 by a very thin ring membrane. A one-way valve unit assembly is positioned between ink chamber 1001 and ink outlet, and the valve unit assembly comprises a bottom cover 1010 with a through hole 1008, valve 1009 with a through hole 1012, and a pressing cover 1013 with a through hole 1011. The head portion of through hole 1012 selectively contacts with a valve plane located on an underside of the pressing cover 1013 depending on the elasticity of the valve 1009 which is made of elastic material. The space between the valve plane and sealing member 1006 defines ink supply chamber 1007. There is a passage 1019 for discharging pressure between ink chamber 1001 and ink supply chamber 1007, which passage is cut off or sealed by a sealing membrane 1018 which is a flexible bag in a contracted state. The volume variation value of the flexible bag between enlarged status and contracted status should be substantially equal to the volume of ink supply needle in the ink supply chamber; and the flexible bag is waterproof, for example the bag may be made of rubber, plastic and so on. Also, the sealing membrane may be designed as an elastic bowl body, the side of which is fixed in the passage 1019. In a new ink cartridge, the sealing membrane 1018 is in the stable state that the bowl bottom is downward, and when the ink supply needle is inserted in, the sealing membrane 1018 is reversed into another stable state such that the bowl bottom is displaced upward when the pressure in ink supply chamber reaches a predetermined value as a result, the volume of the ink supply chamber is enlarged. The volume enclosed between the two steady states should be substantially equal to the volume of ink supply needle in the ink supply chamber.

Embodiment Eleven

Figure 41:
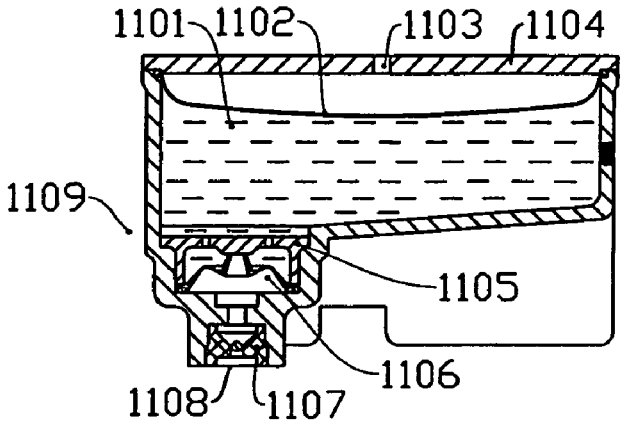
FIG. 41 is a sectional view showing the configuration of the ink cartridge of an eleventh embodiment.

Referring to FIG. 41, the cartridge body 1109 comprises an ink chamber 1101 for storing ink, a cartridge cap 1104 with an air vent 1103 allowing the ink chamber to receive air, and an ink outlet blocked by a sealing member 1107. To prevent ink from leaking out from air vent 1108 when the ink cartridge is removed from the printer or unloaded, in this embodiment, the ink cartridge further comprises a leakage prevention apparatus 1102 surrounding the air vent. The leakage prevention apparatus 1102 is a thin membrane bag made of elastic material with a tiny orifice, whose port is connected to a circumference of the cartridge cap 1104. During printing, as the ink is being constantly consumed, the volume chamber formed between the cartridge cap 1104 and the membrane 1102 is enlarged until the tiny orifice is opened, whereby the air is supplied into the ink chamber to keep a pressure balance in the ink cartridge, and, therefore, the printing can be continued. When the printing is stopped, the tiny orifice that was opened will close depending on the elasticity of the membrane, and as a result, ink cannot flow into the membrane chamber. There is a one-way valve 1106 for controlling ink flow in the ink chamber 1101. The pressing cover 1105 presses tightly on the head support portion of the valve and its valve plane blocks off the through hole of the head support portion of the valve 1106.

Embodiment Twelve

Figure 42:
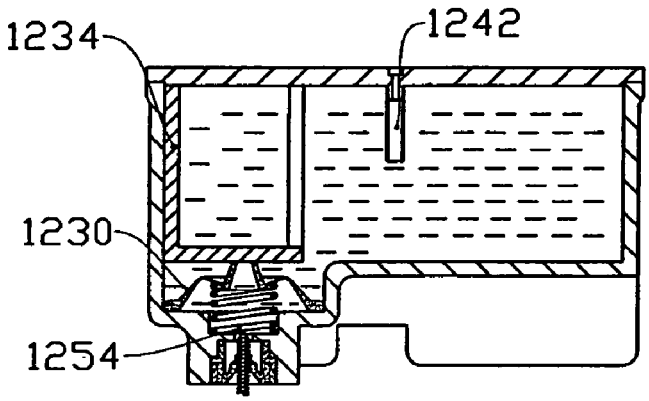
FIG. 42 is a sectional view showing the configuration of the ink cartridge of the twelfth embodiment.
Figure 43:
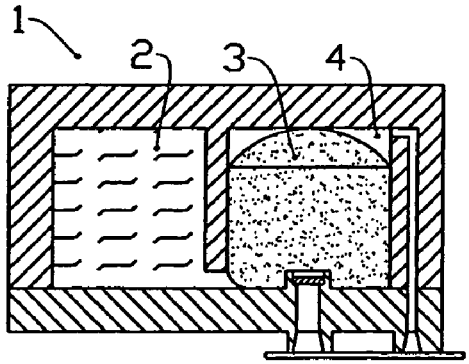
FIG. 43 is a sectional view of one type of conventional ink cartridge.

Referring to FIG. 42, a spring 1254 is interposed between the bellows valve 1230 and the lower wall of the cartridge. The spring 1254 urges the bellows valve 1230 into sealing engagement with the pressing cover 1234 to adjust the pressure sensitivity. A soft tube 1242 extends inside to one third of the depth of the ink chamber to prevent ink from leaking.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A one-way valve unit assembly comprising:

a bottom cover with a through hole for holding a valve;

a pressing cover with a through hole; and an elastic valve disposed between the bottom cover and the pressing cover, the elastic valve including a foot support portion, sealing an interior wall of the bottom cover;

a wall support portion, protruding from an interior wall of the foot support portion;

a shoulder support portion, bending toward an interior of said wall support portion; and a head support portion with a through hole, protruding from said shoulder support portion;

wherein, the pressing cover is maintained selectively in contact with said head support portion through hole of said elastic valve by a pressure difference wherein, a circumference side is at the downside of the foot support portion of the valve; said foot support portion of the valve is provided with a curved part;

said bottom cover is composed of a cylindrical wall, a plane portion, and a circumferential wall protruded from the inner surface portion of the through hole of said bottom cover;

said pressing cover includes a top cover and a cylindrical wall, there is a valve plane in the middle of the top cover for connecting with the head support portion of said valve, and the through hole of the pressing cover is provided in the non-valve plane region and said curved part of said valve is disposed between said circumferential wall of said bottom cover and the end of said vertical wall of said pressing cover.

2. A one-way valve unit assembly according to claim 1 wherein, a leg provided with separated ribs is protruded from the external surface of the through hole portion of said bottom cover.

3. A one-way valve unit according to claim 1 incorporated in an ink cartridge, comprising a cartridge body with an ink chamber, an ink outlet and an air vent, wherein, said ink chamber is composed of a main chamber and a supplementary chamber connected with each other, and an ink out detecting prism;

wherein, the pressing cover being maintained selectively in contact with said head support portion through hole of said elastic valve by a pressure difference.

4. An ink cartridge according to claim 3, wherein, said supplementary chamber is a part of said main chamber.

5. An ink cartridge according to claim 3, wherein, said ink out detecting prism is a projection projecting from a wall of said cartridge body.

6. An ink cartridge according to claim 3, wherein, a partition wall is provided between the main chamber and the supplementary chamber, and the main chamber and supplementary chamber are connected through an ink passage way at the bottom of the ink cartridge.

7. An ink cartridge according to claim 6, wherein, the supplementary chamber is sealed except said ink passage way.

8. A one-way valve unit according to claim 1 incorporated in an ink cartridge, comprising a cartridge body with an ink chamber and a cover with an air vent, an ink outlet with an ink guiding member, wherein, a concave chamber surrounding the air vent is provided on the inner surface of the cover, and the air vent is disposed with a ventilated and waterproof stopper;

a row of slope localization protrusions provided on the cover; and a sealing member provided within said ink outlet, said sealing member having a funnel-shaped hole changing from a circle to an ellipse.

9. An ink cartridge according to claim 8, wherein, said valve is bellows-shaped.

10. An ink cartridge according to claim 9, wherein, the cartridge body comprises at least three ink chambers;

each chamber having an independent air vent, a concave chamber and a ventilated and waterproof stopper in the cover of the ink cartridge; and each chamber having an independent ink outlet, a one-way valve unit and ink passage ways.

11. A one-way valve unit according to claim 1 incorporated in an ink cartridge, comprising a cartridge body with an ink chamber, an ink outlet with a sealing member on a side and an air vent connecting the ink chamber with the ambient air, wherein, a valve socket formed on one side of the cartridge body vertically disposed with the one-way valve unit;

a fiber member disposed within the ink outlet; and ink passages communicated between the ink chamber and the valve socket.

12. An ink cartridge according to claim 11, wherein, said valve is bellows-shaped.

13. A one-way valve unit according to claim 1 incorporated in an ink cartridge, comprising at least three ink chambers, wherein the ink chambers are separated by partition walls;

at least a one-way valve unit assembly provided within each chamber;

at least an ink supply tube formed on a bottom side of the ink cartridge to transfer the ink from the valve unit to the ink outlet;

said one-way valve unit assembly comprising a bottom cover with a through hole for holding a valve, a pressing cover with a through hole, and an elastic valve with a head support portion through hole disposed between the bottom cover and the pressing cover, said pressing cover being maintained selectively in contact with said head support portion through hole of said elastic valve by a pressure difference.

14. An ink cartridge according to claim 13, wherein, said valve is bellows-shaped.

15. An ink cartridge, comprising an ink chamber with an air vent, ink outlet and a one-way valve unit assembly according to claim 1 and an ink supply chamber, further comprising an idle member disposed within said ink supply chamber for the engagement with the ink supply needle, said idle member withdraws upon the insertion of said ink supply needle.

16. An ink cartridge according to claim 1, a spring is interposed between the valve and the lower wall of the cartridge to urge the valve into sealing engagement with the pressing cover to adjust the pressure sensitivity.

* * * * *